US008767970B2

(12) United States Patent
Eppolito

(10) Patent No.: US 8,767,970 B2
(45) Date of Patent: Jul. 1, 2014

(54) AUDIO PANNING WITH MULTI-CHANNEL SURROUND SOUND DECODING

(75) Inventor: Aaron M. Eppolito, Santa Cruz, CA (US)

(73) Assignee: Apple Inc., Cupertino, CA (US)

( * ) Notice: Subject to any disclaimer, the term of this patent is extended or adjusted under 35 U.S.C. 154(b) by 224 days.

(21) Appl. No.: 13/151,181

(22) Filed: Jun. 1, 2011

(65) Prior Publication Data

US 2012/0210223 A1 Aug. 16, 2012

Related U.S. Application Data

(60) Provisional application No. 61/443,670, filed on Feb. 16, 2011, provisional application No. 61/443,711, filed on Feb. 16, 2011.

(51) Int. Cl.
*H04R 5/00* (2006.01)
*H04R 5/02* (2006.01)

(52) U.S. Cl.
USPC ..... 381/22; 381/307

(58) Field of Classification Search
USPC ..... 381/307, 309, 17–23
See application file for complete search history.

(56) References Cited

U.S. PATENT DOCUMENTS

| | | | | |
|---|---|---|---|---|
| 5,956,031 | A | 9/1999 | Berteig et al. | |
| 6,507,658 | B1 | 1/2003 | Abel et al. | |
| 6,850,254 | B1 | 2/2005 | Banning et al. | |
| 7,039,876 | B2 | 5/2006 | Lavendel et al. | |
| 7,092,542 | B2 | 8/2006 | McGrath | |
| 7,221,379 | B2 | 5/2007 | Mullins et al. | |
| 7,383,509 | B2 | 6/2008 | Foote et al. | |
| 7,548,791 | B1 | 6/2009 | Johnston | |
| 7,549,123 | B1 | 6/2009 | Stewart et al. | |
| 7,653,550 | B2 | 1/2010 | Schulz | |
| 7,698,009 | B2 * | 4/2010 | Cotey et al. | 700/94 |
| 7,756,281 | B2 | 7/2010 | Goldstein et al. | |
| 7,873,917 | B2 | 1/2011 | Brinkmann et al. | |
| 7,957,547 | B2 * | 6/2011 | Chin | 381/306 |
| 8,249,283 | B2 * | 8/2012 | Ando et al. | 381/306 |
| 2002/0177967 | A1 | 11/2002 | Fuchs et al. | |
| 2002/0190991 | A1 | 12/2002 | Efran et al. | |
| 2003/0039408 | A1 | 2/2003 | Smith | |
| 2004/0066396 | A1 | 4/2004 | Hatakenaka | |
| 2006/0066628 | A1 | 3/2006 | Brodie et al. | |
| 2007/0287490 | A1 | 12/2007 | Green et al. | |
| 2008/0002844 | A1 | 1/2008 | Chin | |
| 2008/0232617 | A1 * | 9/2008 | Goodwin et al. | 381/307 |
| 2008/0253577 | A1 | 10/2008 | Eppolito | |
| 2008/0253592 | A1 * | 10/2008 | Sanders et al. | 381/306 |
| 2009/0091563 | A1 | 4/2009 | Viz et al. | |
| 2009/0129601 | A1 | 5/2009 | Ojala et al. | |

(Continued)

OTHER PUBLICATIONS

Author Unknown, "Using Adobe Premiere Elements 8 Editor," last updated Aug. 12, 2010, pp. 146-167, Adobe Systems Incorporated, San Jose, California, USA.

(Continued)

*Primary Examiner* — Xu Mei
(74) *Attorney, Agent, or Firm* — Adeli LLP

(57) ABSTRACT

A panner is provided that incorporates a surround sound decoder. The panner takes as input the desired panning effect that a user requests, separates sounds using surround sound decoding, and places the separated sounds in the desired places in an output sound field.

19 Claims, 25 Drawing Sheets

(56) References Cited

U.S. PATENT DOCUMENTS

| | | | | |
|---|---|---|---|---|
| 2009/0144063 | A1* | 6/2009 | Beack et al. | 704/500 |
| 2010/0157726 | A1* | 6/2010 | Ando et al. | 367/7 |
| 2010/0170758 | A1* | 7/2010 | Chen | 188/250 G |
| 2010/0189266 | A1 | 7/2010 | Oh et al. | |
| 2010/0199204 | A1 | 8/2010 | Oh et al. | |
| 2011/0007915 | A1 | 1/2011 | Park | |
| 2011/0145743 | A1 | 6/2011 | Brinkmann et al. | |
| 2012/0207309 | A1 | 8/2012 | Eppolito | |
| 2012/0210262 | A1 | 8/2012 | Sheeler et al. | |

OTHER PUBLICATIONS

Author Unknown, "Adobe Premiere PRO CS3: User Guide," Apr. 1, 2008, pp. 240-278, Adobe Systems Incorporated, San Jose, California, USA.

U.S. Appl. No. 13/105,858, filed May 11, 2011, Sheeler, Stephen, et al.

U.S. Appl. No. 13/151,199, filed Jun. 1, 2011, Eppolito, Aaron M.

Portions of prosecution history of U.S. Appl. No. 11/271,081, filed Dec. 10, 2010, Brinkmann, Ron, et al.

Author Unknown, "Additional Presets," Month Unknown, 2007, pp. 1-2, iZotope, Inc.

Author Unknown, "Octogris by UDM," Month Unknown, 2000-2011, pp. 1-3, KVR Audio Plugin Resources.

Author Unknown, "PCM 81 Presets," Month Unknown, 1989, Lexicon, Bedford Massachusetts, USA.

Author Unknown, "Spectron—64-bit Spectral Effect Processor," Month Unknown, 2007, pp. 1-3, iZotope, Inc.

Lee, Taejin, et al., "A Personalized Preset-Based Audio System for Interactive Service," Audio Engineering Society (AES) 121st Convention, Oct. 5-8, 2006, pp. 1-6, San Francisco, CA, USA.

* cited by examiner

| Pan Input (1205) | Decode Balance (dB) | Ls/Rs Width (dB) | F/R Bias (dB) (1225) | Signals received at speakers (1210, 1220, 1215, 1230) |
|---|---|---|---|---|
| A: | -∞ | 0 | 0 | Lt+Rt; 0; 0; 0; 0 |
| B: | 0 | +6 dB | -6 dB | Pl+Cl; Pl+J+Pr; Pr+Cr; Cl; Cr |
| C: | 0 | +3 dB | 0 | Pl; J; Pr; Cl; Cr |
| D: | 0 | +1 dB | +3 dB | Pl; J; Pr; Pl+Cl+Cr; Pr+Cl+Cr |
| E: | 0 | +1 dB | +6 dB | J+Pl; J; J+Pr; Pl+C; Pr+C |
| F: | -∞ | 0 | 0 | 0; 0; 0; Lt; Rt |
| I: | 0 | +6 dB | 0 | Cl+Pl; J + Pr; Pr; Cl+Cr; Cr+Pr |
| J: | -6 dB | +6 dB | 0 | F+ Rt; 0; 0; R+Rt; 0 |
| G: | 0 | +6 dB | 0 | Pl; Pl+J; Pr+Cr; Pl+Cl; Cl+Cr |
| H: | -6 dB | +6 dB | 0 | 0; 0; F+Lt; 0; R+Lt |

*FIGURE 12*

AUDIO PANNING WITH MULTI-CHANNEL SURROUND SOUND DECODING

CLAIM OF BENEFIT TO PRIOR APPLICATIONS

The present Application claims the benefit of U.S. Provisional Patent Application 61/443,670, entitled, "Audio Panning with Multi-Channel Surround Sound Decoding," filed Feb. 16, 2011 and U.S. Provisional Patent Application 61/443,711, entitled, "Panning Presets," filed Feb. 16, 2011. The contents of U.S. Provisional Patent Application 61/443,670 and U.S. Provisional Patent Application 61/443,711 are hereby incorporated by reference.

BACKGROUND

Panning operations and surround sound decoding operations are mathematically distinct functions that affect the distribution of sound across a speaker system. Panning is the spread of a sound signal into a new multi-channel sound field. Panning is a common function in multi-channel audio systems. Panning functions distribute sound across multi-channel sound systems. In effect, panning "moves" the sound to a different speaker. If the audio is panned to the right, then the right speaker gets most of the audio stream and the left speaker output is reduced.

Surround sound decoding is the mathematical or matrix computations necessary to transform two-channel audio into the necessary multi-channel audio stream to support a surround sound system. Surround sound decoding is the process of transforming two-channel audio input into multi-channel audio output. Audio that is recorded in 5.1 is often encoded in a two-channel format to be broadcast in environments that only support the two-channel format, like broadcast television. Encoding can be of a mathematical form or a matrix form. Mathematical forms require a series of mathematical steps and algorithms to decode. DTS and Dolby Digital perform mathematical encoding. Matrix encoding relies on matrix transforms to encode 5.1 channel audio into a two-channel stream. Audio in matrix encoding can be played either encoded or decoded and be sound acceptable to the end user.

BRIEF SUMMARY

Some embodiments provide a panner that incorporates a surround sound decoder. The panner takes as input the desired panning effect that a user requests, separates sounds using surround sound decoding, and places the separated sounds in the desired places in an output sound field. Use of surround sound decoding by the panner provides several advantages for placing the sound in the field over the panners that do not use decoding.

Panners use collapsing and/or attenuating techniques to create a desired panning effect. Collapsing relocates the sound to a different location in the sound space. Attenuating increases the strength of one or more sounds and decreases the strength of one or more other sounds in order to create the panning effect. However, collapsing sounds folds down all input signal sources into a conglomerate of sounds and sends them to where the panning is directed to. As a result unwanted sounds that were not intended to be played at certain speakers cannot be separated from the desired sounds and are sent in the panning direction. Also, attenuating sounds without separating them often creates unwanted silence.

A collapsing panner that incorporates surround sound decoding increases the separation between the source signals prior to collapsing them and thereby provides the advantage that all signals are not folded into the same speaker. Another advantage of separating the sounds prior to collapsing them is preventing the same sound to be sent to multiple unwanted speakers thereby maintaining the uniqueness of the sounds at desired speakers. A panner that incorporates surround sound decoding also provides an enabling technology for attenuating panners in many situations where attenuating the sounds prior to separation creates silence.

The preceding Summary is intended to serve as a brief introduction to some embodiments of the invention. It is not meant to be an introduction or overview of all inventive subject matter disclosed in this document. The Detailed Description that follows and the Drawings that are referred to in the Detailed Description will further describe the embodiments described in the Summary as well as other embodiments. Accordingly, to understand all the embodiments described by this document, a full review of the Summary, Detailed Description and the Drawings is needed. Moreover, the claimed subject matters are not to be limited by the illustrative details in the Summary, Detailed Description and the Drawings, but rather are to be defined by the appended claims, because the claimed subject matters can be embodied in other specific forms without departing from the spirit of the subject matters.

BRIEF DESCRIPTION OF THE DRAWINGS

The novel features of the invention are set forth in the appended claims. However, for purpose of explanation, several embodiments of the invention are set forth in the following figures.

FIG. 12 conceptually illustrates panning inputs for decoding the Lt and Rt channels in order to reproduce the sound in the output space that approximates the sound at different locations A-J of the input space in some embodiments.

DETAILED DESCRIPTION

Figure 1:
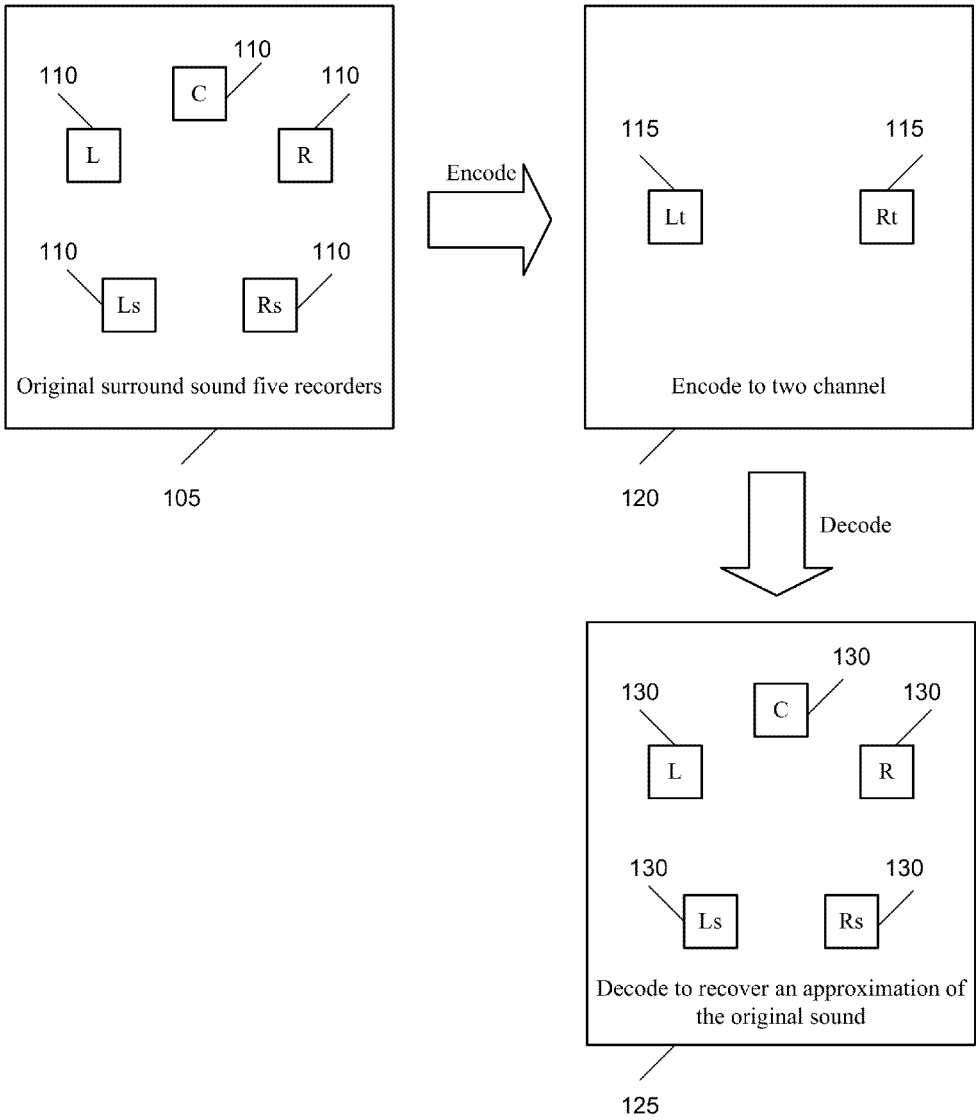
FIGURE 1 Prior Art
FIG. 1 conceptually illustrates surround sound encoding and decoding in three stages.

In the following detailed description of the invention, numerous details, examples, and embodiments of the invention are set forth and described. However, it will be clear and apparent to one skilled in the art that the invention is not limited to the embodiments set forth and that the invention may be practiced without some of the specific details and examples discussed.

Some embodiments provide a panner that incorporates a surround sound decoder. The panner takes as input the desired panning effect that a user requests, separates sounds using surround sound decoding, and places the separated sounds in the desired places in an output sound field. Use of surround sound decoding by the panner provides several advantages for placing the sound in the field over the panners that do not use decoding.

Panners use collapsing and/or attenuating techniques to create a desired panning effect. Collapsing relocates the sound to a different location in the sound space. Attenuating increases the strength of one or more sounds and decreases the strength of one or more other sounds in order to create the panning effect. However, collapsing sounds folds down all input signal sources into a conglomerate of sounds and sends them to where the panning is directed to. As a result unwanted sounds that were not intended to be played at certain speakers cannot be separated from the desired sounds and are sent in the panning direction. Also, attenuating sounds without separating them often creates unwanted silence.

A collapsing panner that incorporates surround sound decoding increases the separation between the source signals prior to collapsing them and thereby provides the advantage that all signals are not folded into the same speaker. Another advantage of separating the sounds prior to collapsing them is preventing the same sound to be sent to multiple unwanted speakers thereby maintaining the uniqueness of the sounds at desired speakers. A panner that incorporates surround sound decoding also provides an enabling technology for attenuating panners in many situations where attenuating the sounds prior to separation creates silence.

Several more detailed embodiments of the invention are described in sections below. Section I provides an overview of panning and decoding operations. Next, Section II describes a panner that uses surround sound decoding in some embodiments. Section III describes rigging of master controls to subordinate controls in some embodiments. Section IV describes the graphical user interface of a media-editing application in some embodiments. Finally, a description of an electronic system with which some embodiments of the invention are implemented is provided in Section V.

I. Overview

A. Definitions

1. Audio Panning

Audio panning is the spreading of audio signal in a sound space. Panning can be done by moving a sound signal to certain audio speakers. Panning can also be done by changing the width, attenuating, and/or collapsing the audio signal. The width of an audio signal refers the width over which sound appears to originate to a listener at a reference point in the sound space (e.g., a width of 0.0 corresponds to a point source). Attenuation means that the strength of one or more sounds is increased and the strength of one or more other sounds is decreased. Collapsing means that sound is relocated (not re-proportioned) to a different location in the sound space.

Audio panners allow an operator to create an output signal from a source audio signal such that characteristics such as apparent origination and apparent amplitude of the sound are controlled. Some audio panners have a graphical user interface that depicts a sound space having a representation of one or more sound devices, such as audio speakers. As an example, the sound space may have five speakers placed in a configuration to represent a 5.1 surround sound environment. Typically, the sound space for 5.1 surround sound has three speakers to the front of the listener (front left (L) and front right (R), and center (C)), two surround speakers at the rear (left surround (Ls) and right surround (Rs)), and one channel for low frequency effects (LFE). A source signal for 5.1 surround sound has five audio channels and one LFE channel, such that each source channel is mapped to one audio speaker.

2. Surround Sound Decoding

Surround sound decoding is an audio technology where a finite number of discrete audio channels (e.g., two) are decoded into a larger number of channels on play back (e.g., five or seven). The channels may or may not be encoded before transmission or recording by an encoder. The terms "surround sound decoding" and "decoding" are used interchangeably throughout this specification.

FIG. 1 conceptually illustrates surround sound encoding and decoding in three stages. As shown, original audio is recorded in the first stage 105 using a set of recorders 110. In this example five recorders are used for recording left, center, right, left surround, and right surround signals. The audio signal is then encoded into two channels 115 and sent to a decoder in the second stage 120. The channels are referred to as left total (Lt) and right total (Rt). The decoder then decodes the received channels into a set of channels 130 (five in this example) to recover an approximation of the original sound in the third stage 125.

As an example, a simple surround sound decoder uses the following formula to derive the surround sound signal from the encoded signals.

$$L=Lt$$

$$R=Rt$$

$$C=0.7*(Lt+Rt)$$

$$Ls=Rs=0.5*(Lt-Rt)$$

where L, R, C, Ls, Rs, Lt, and Rt are left, right, center, left surround, right surround, left total, and right total signals respectively.

B. Graphical User Interface

Figure 2:
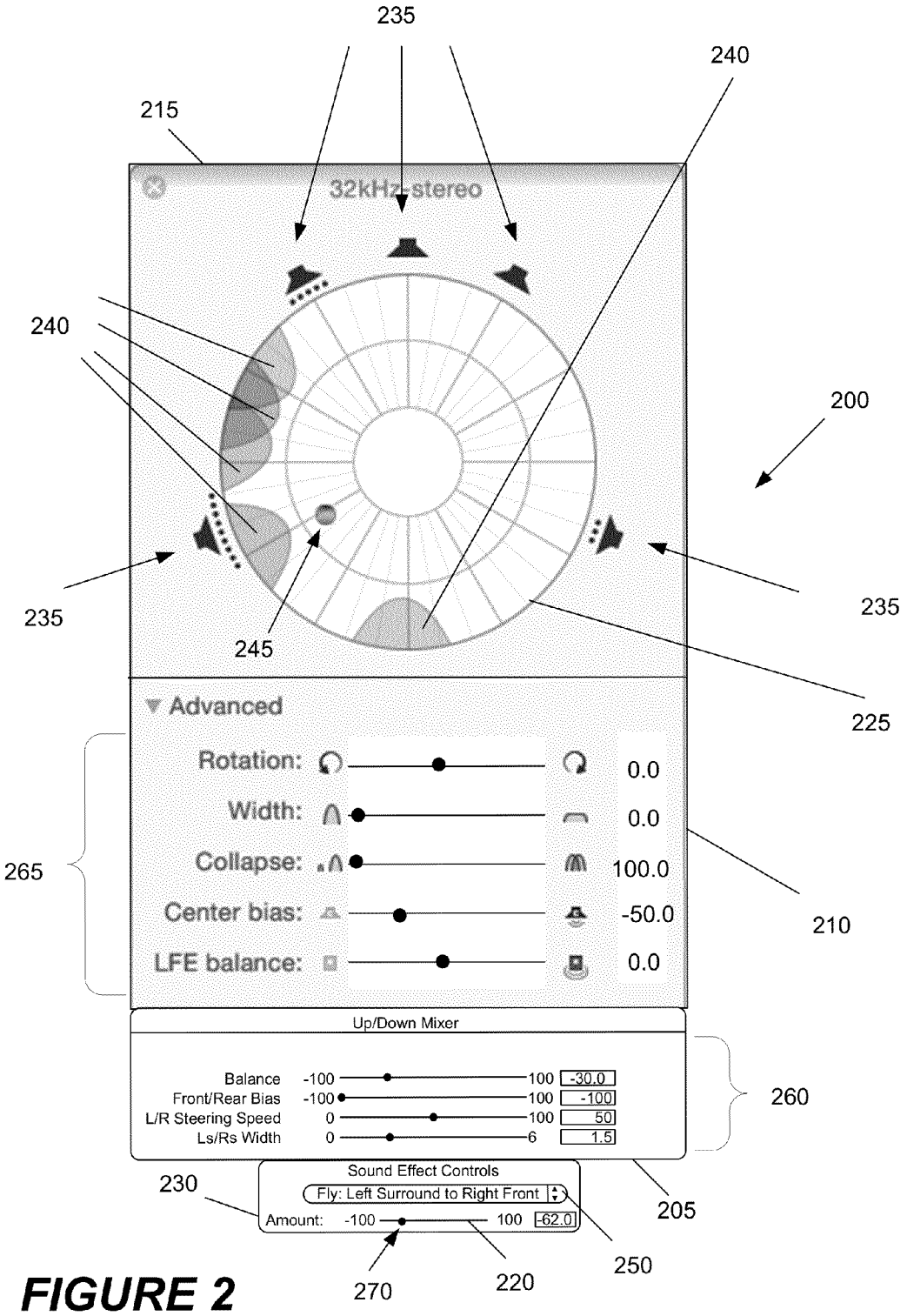
FIG. 2 conceptually illustrates a graphical user interface (GUI) of a media editing application of some embodiments.

FIG. 2 conceptually illustrates a graphical user interface (GUI) 200 of some embodiments. Different portions of this graphical user interface are used in the following sections to provide examples of the methods and systems of some embodiments. However, the invention may be practiced without some of the specific details and examples discussed. One of ordinary skill in the art will recognize that the graphical user interface 200 is only one of many possible GUIs for such a media editing application. Furthermore, as described by reference to FIG. 25 below, GUI 200 is part of a larger graphical interface 2500 of a media editing application in some embodiments. In other embodiments, this GUI is used as a part of an audio/visual system. In other embodiments, this GUI runs on an electronic device such as a computer (e.g., a desktop computer, personal computer, tablet computer, etc.), a cell phone, a smart phone, a PDA, an audio system, an audio/visual system, etc.

As shown in FIG. 2, the display area 205 for adjusting decoding parameters includes controls for adjusting balance (also referred to as original/decoded) which selects the amount of decoded versus original signal, front/rear bias (also referred to as ambient/direct), left/right steering speed, and left surround/right surround width (also referred to as surround width). The display area 210 for adjusting panning parameters includes controls for adjusting LFE (shown as LFE balance), rotation, width (also referred to as stereo spread), collapse (also referred to as attenuate/collapse) which selects the amount of collapsing versus attenuating panning, and center bias (also referred to as center balance). The sound space 225 is represented by a circular region with five speakers 235 around the perimeter. The five visual elements 240 represent five different source audio channels and represent how each source channel is heard by a listener at a reference point (e.g., at the center) in the output sound space 225. Each visual element 240 depicts the width of origination of its corresponding source channel and refers to how much of the circumference of the sound space 225 the source channel appears to originate. The puck 245 represents the point at which the collective sound of all of the source channels appears to originate from the perspective of a listener in the middle of the sound space 225. In some embodiments, the sound space is reconfigurable. For instance, the number and positions of speakers 235 are configurable.

FIG. 2 also illustrates that the display area 230 includes a control (in this example a knob 270) on slider 220 that controls both panning and decoding. The display area 230 also includes a control 250 (also referred to as pan mode) for selecting one of several different effects for panning and decoding. These controls are described in detail further below.

II. Panner That Uses Surround Sound Decoding

Figure 3:
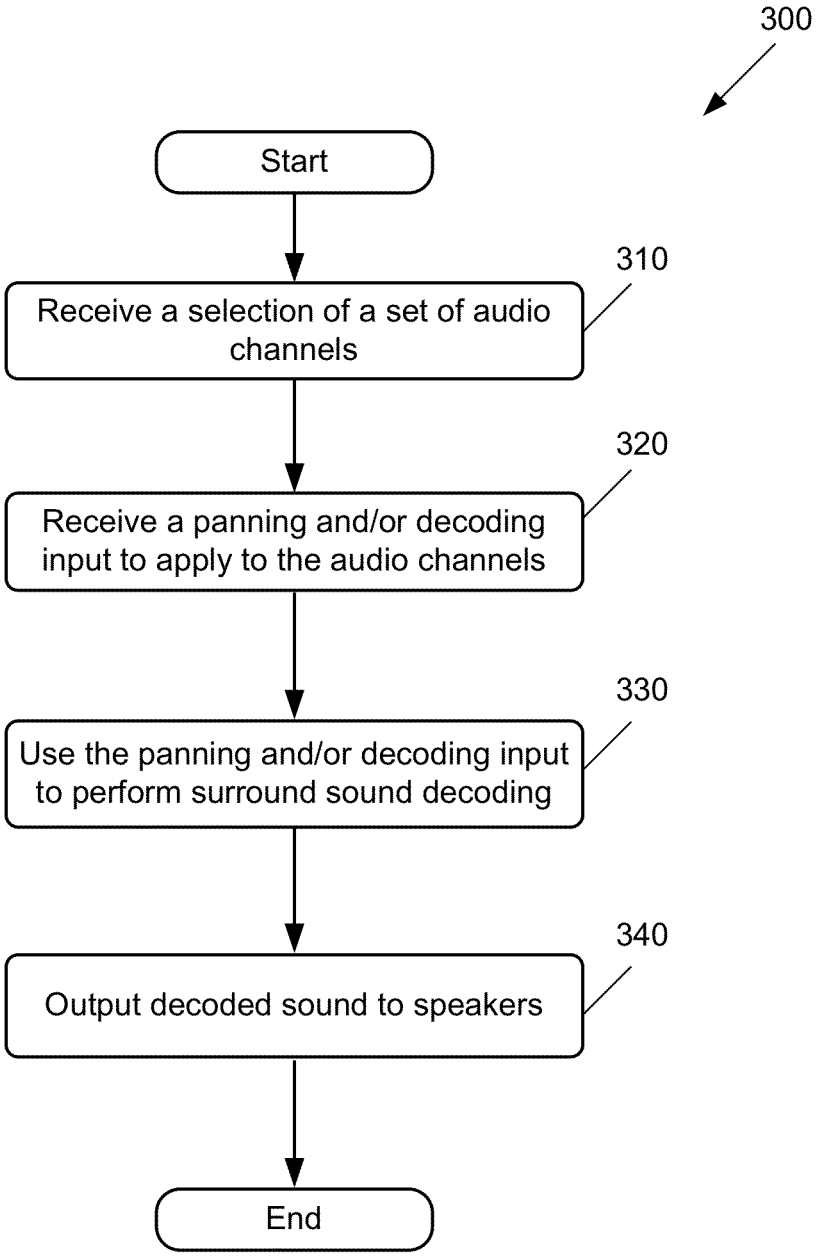
FIG. 3 conceptually illustrates a process of some embodiments for performing surround sound decoding by using panning input.

FIG. 3 conceptually illustrates a process 300 of some embodiments for performing panning operations. As shown, process 300 receives (at 310) a selection of a set of audio channels (e.g., Lt and Rt signals). In some embodiments, the audio channels are part of a media clip that includes either audio content or both audio and video content. Next, the process receives (at 320) a panning and/or decoding input to apply to the audio channels. In some embodiments, such an input is received through a GUI such as GUI 200. The panning input is received when a user either changes a value of one of the panning parameters 265 or moves the puck 245 inside the sound space 225 (i.e., changing the panning x and/or y coordinate parameters). The decoding input is received when the user changes a value of one of the decoding parameters 260. Next, the process uses the received input to perform (at 330) surround sound decoding on the selected audio channels. Different embodiments perform decoding differently. In some embodiments, the panning and/or decoding input is used to influence and modify the decoding of the signal to favor (or disfavor) certain audio channels based on where the user has decided to pan the signal. For instance, when the panning is towards left rear, the decoder in some embodiments favors the left channel more than the right channel. In addition or instead, the decoder might block the center channel in some embodiments. In the same scenario of panning towards left rear, the decoder in some embodiments might attenuate the front and favor the surround signal.

The process finally sends (at 340) the decoded sound to the speakers. The process then ends. In some embodiments, after the panning input is used by the decoder to decode the signal, an actual panning is also performed (i.e., the sounds is physically moved towards the panned direction) when the output signal is sent to the speakers.

One of ordinary skill in the art will recognize that process 300 is a conceptual representation of the operations used to perform decoding by using panning inputs and to perform panning operations. The specific operations of process 300 may not be performed in the exact order shown and described. The specific operations may not be performed in one continuous series of operations, and different specific operations may be performed in different embodiments. Furthermore, the process could be implemented using several sub-processes, or as part of a larger macro process.

A. Examples of Panning Using Surround Sound Decoding

Figure 4:
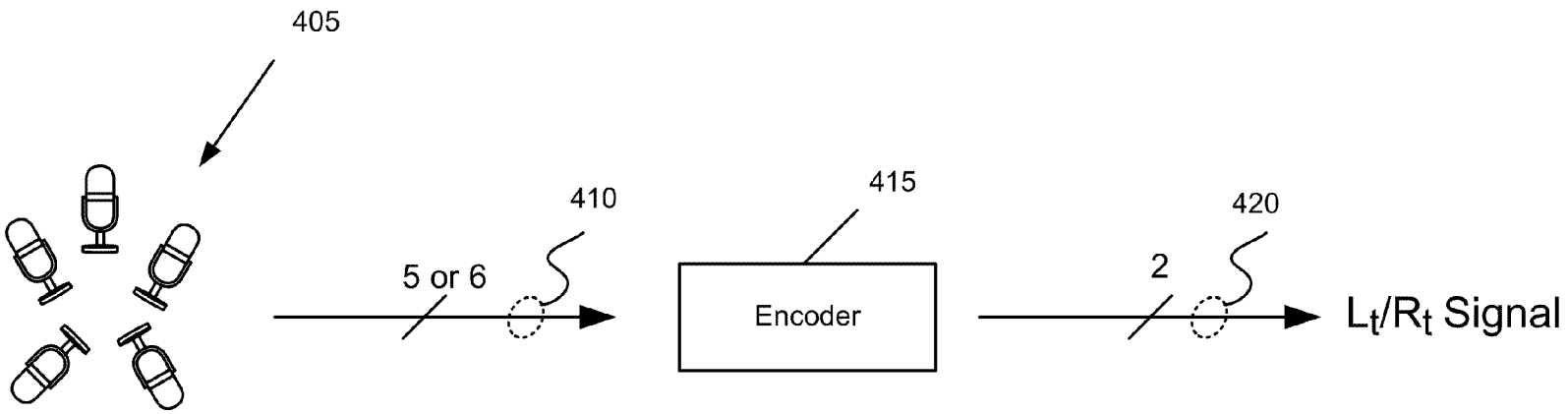
FIG. 4 conceptually illustrates a group of microphones recording sound in several channels in some embodiments.

FIGS. 4-10 conceptually illustrate an example of the application of process 300 for panning and surround sound decoding in some embodiments. FIG. 4 illustrates a group 405 of five or six (five are shown) microphones recording sound in five or six channels 410 in some embodiments. The recorded signal is encoded by an encoder 415. The resulting Lt/Rt signal 420 is therefore mathematically encoded from the five or six channel source.

Figure 5:
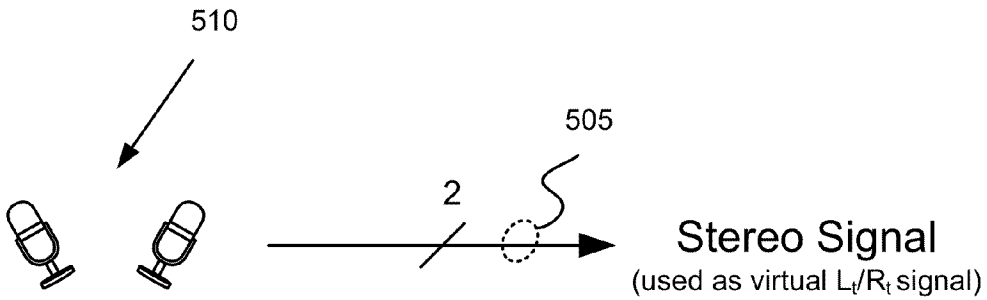
FIG. 5 conceptually illustrates a stereo signal which is recorded by a pair of microphones in some embodiments.

FIG. 5 conceptually illustrates a stereo signal 505 which is recorded by a pair 510 of microphones in some embodiments. Although this signal is transmitted without being encoded, due to the characteristics of Lt/Rt encoding the signal can be used as a virtual Lt/Rt signal. Therefore, references to Lt/Rt signals in different discussions throughout this specification apply both to encoded signals (such as 420) and not encoded stereo signals (such as 505).

Figure 6:
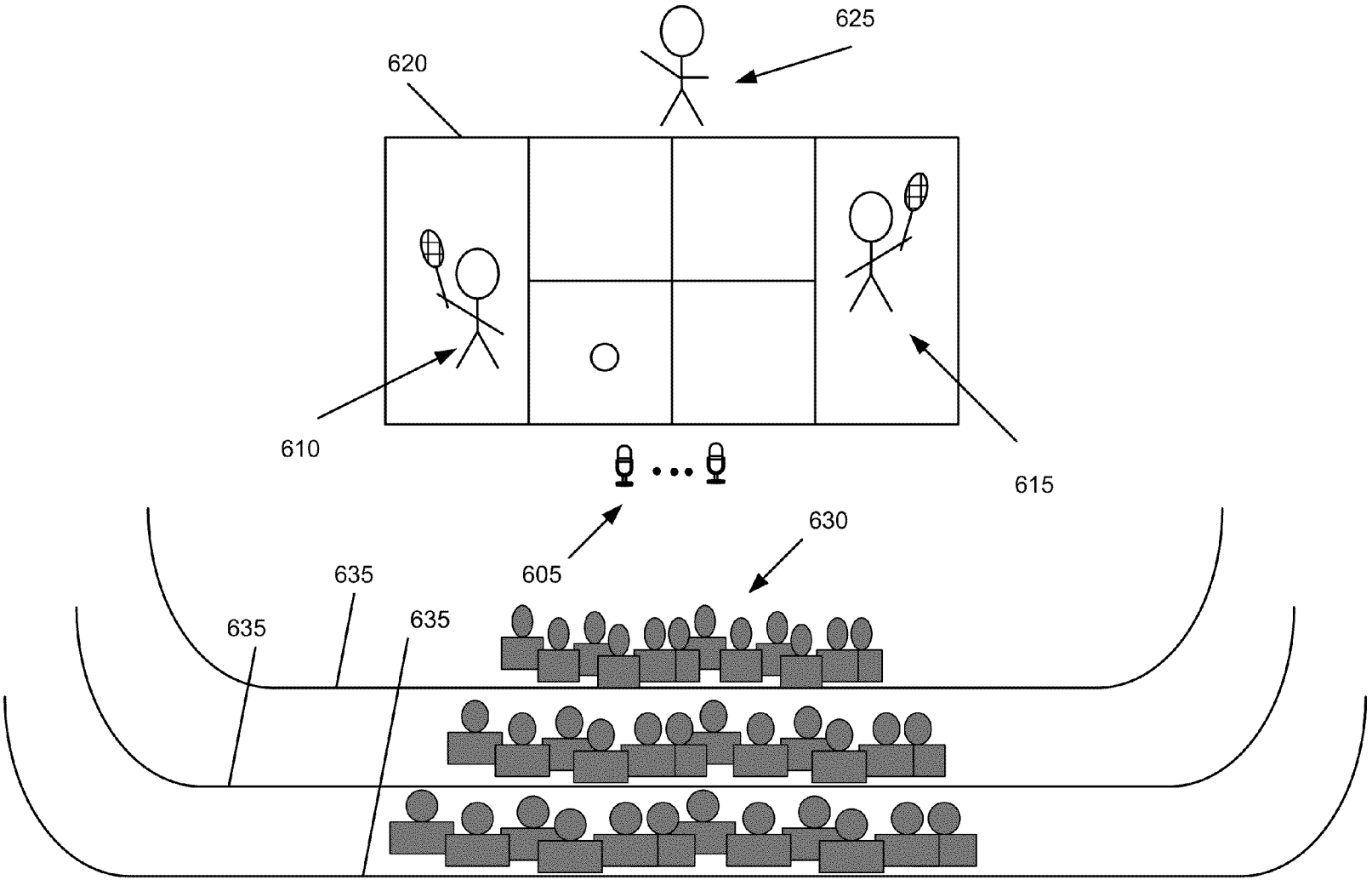
FIG. 6 conceptually illustrates a tennis match recorded by a set of microphones in some embodiments.

FIG. 6 conceptually illustrates a tennis match recorded by a set of microphones 605 in some embodiments. These microphones are either stereo or surround sound encoded to Lt/Rt as described by reference to FIGS. 4-5. Other arrangements and numbers of microphones are also possible for the set of microphones 605 in some embodiments. FIG. 6 shows two tennis players 610-615 to the left and right of the tennis court 620 respectively. FIG. 6 also shows a line judge 625 to the front and crowd 630 sitting on stands 635 behind the microphones 605. The predominant sources of audio in this example are provided by the voice of the judge and the sound of players playing tennis Ambient sound is also picked up by the microphones 605. Sources of ambient sound include crowd noise as well as echoes that bounce off the objects and stands around the field.

Figure 7:
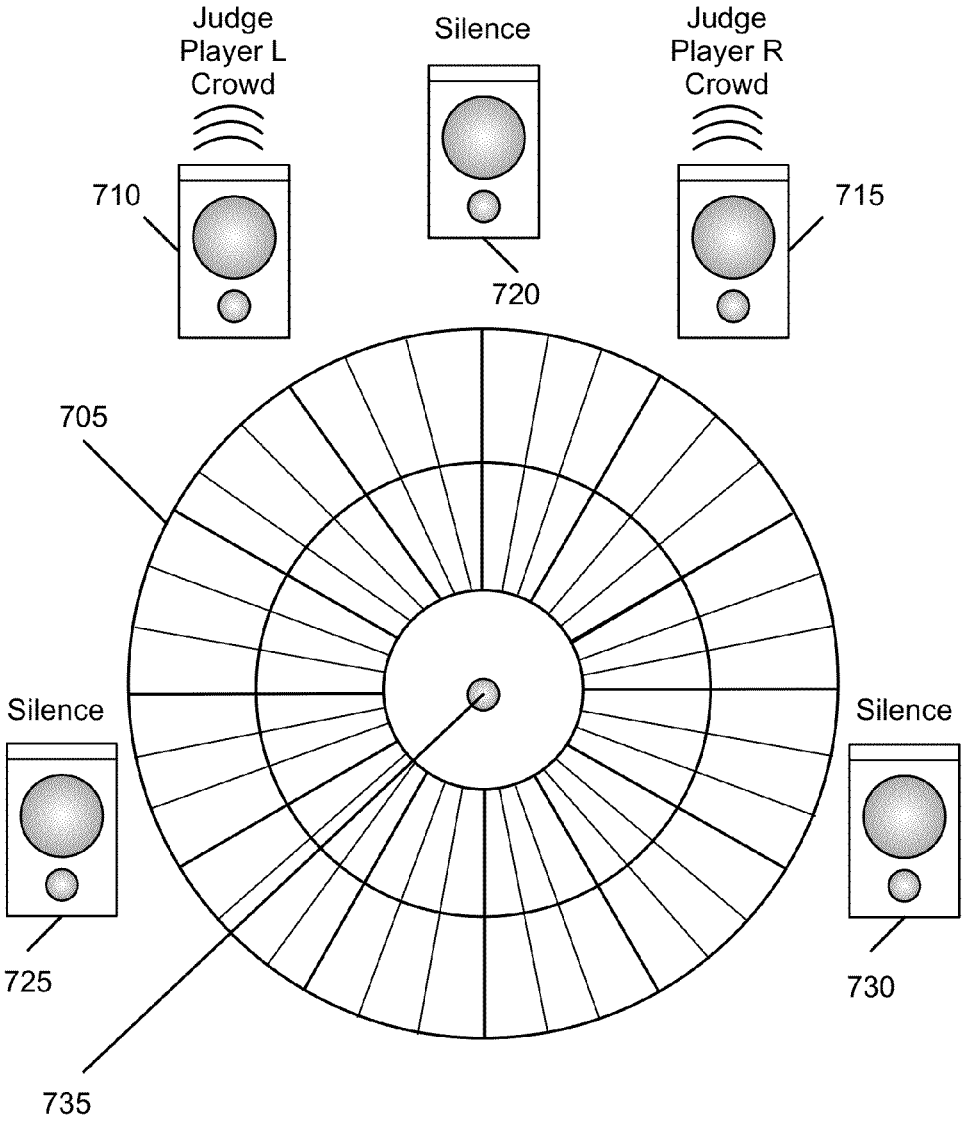
FIG. 7 conceptually illustrates an output sound space where sounds recorded by microphones are played on surround sound speakers without surround sound decoding.

FIG. 7 conceptually illustrates an output sound space 705 where sounds recorded by microphones 605 (as shown in FIG. 6) and received as two-channel Lt/Rt are played on surround sound speakers 710-730 without panning (as shown by the puck 735 positioned on the center of the sound space 705) or surround sound decoding. As shown in FIG. 7, sound comes out of the left speaker 710 and the right speaker 715 exclusively, while the center 720, left surround 725, and right surround 730 are silent. As shown, the sounds related to the judge 625, left player 610, and crowd 630 come out of the left speaker 710 and sounds related to the judge 625, right player 615, and crowd 630 come out of the right speaker 715. This is not desirable in a surround sound environment because ideally the center speaker 720 is used to play the sound from the center of the sound space (in this case the voice of the judge 625). Also, the left 710 and right 715 front speakers are used to play the sound of objects to the left and right of the center respectively (in this case the sounds of the left player 610 and the right player 615 respectively). Furthermore, the left surround and the right surround speakers are used to play the sound coming from behind which is usually the surround sound (in this case the sound from the crowd 630)

Figure 8:
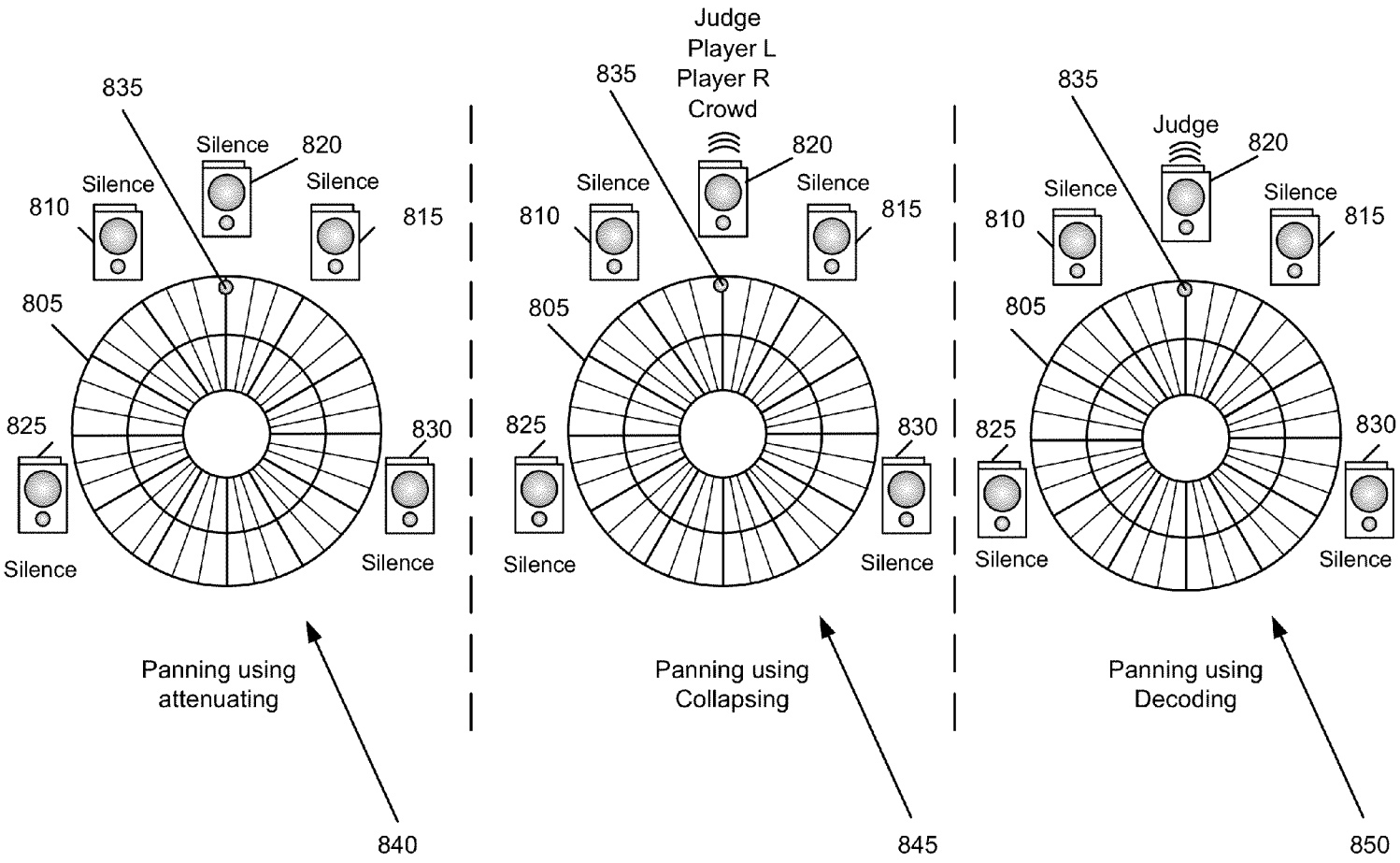
FIG. 8 illustrates an output sound space and the output channels at each speaker when the puck is at the front center (at 0° position) of the sound space.
Figure 9:
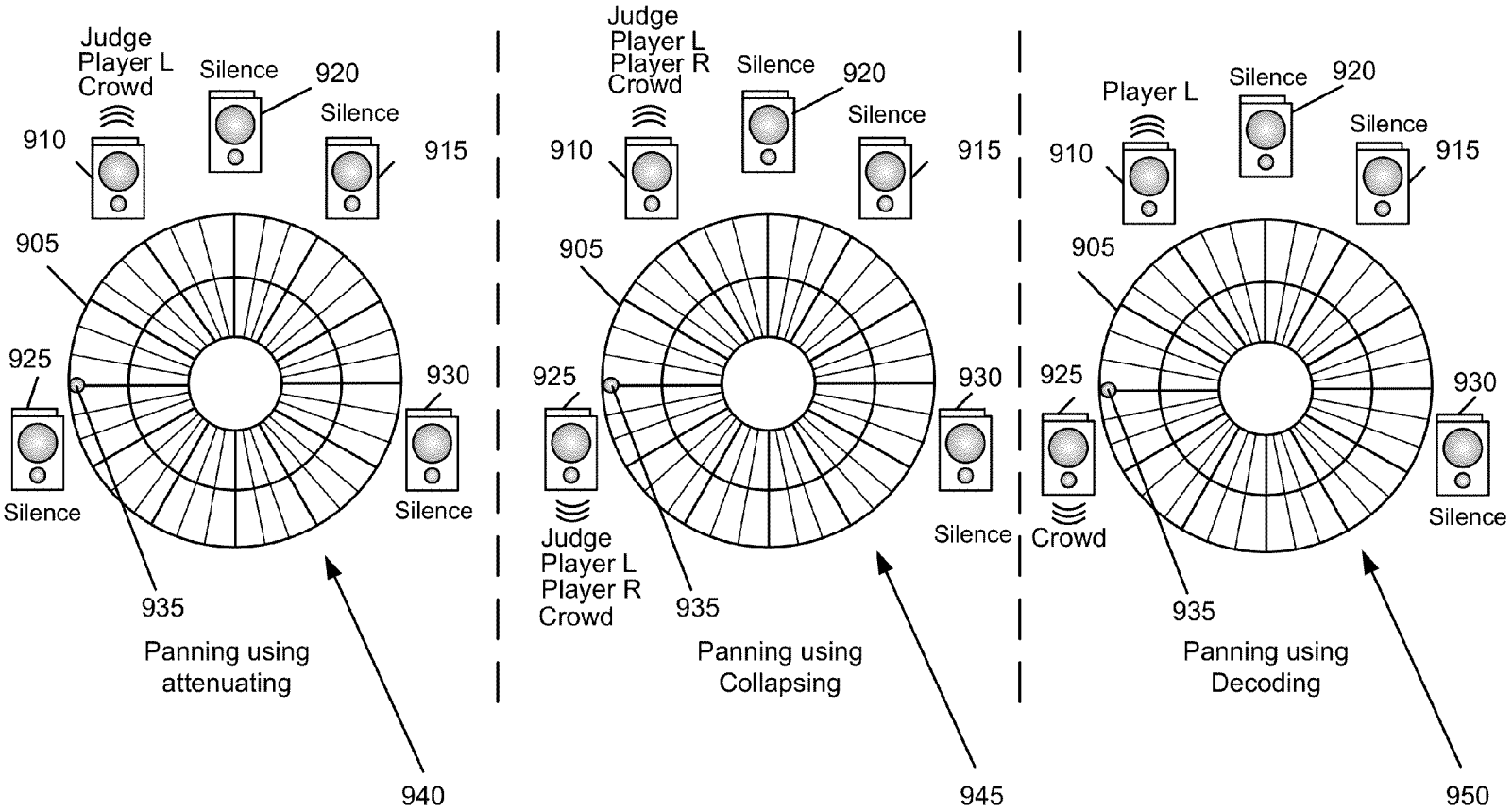
FIG. 9 illustrates an output sound space and the output channels at each speaker when the puck is at the left most position in the sound space.
Figure 10:
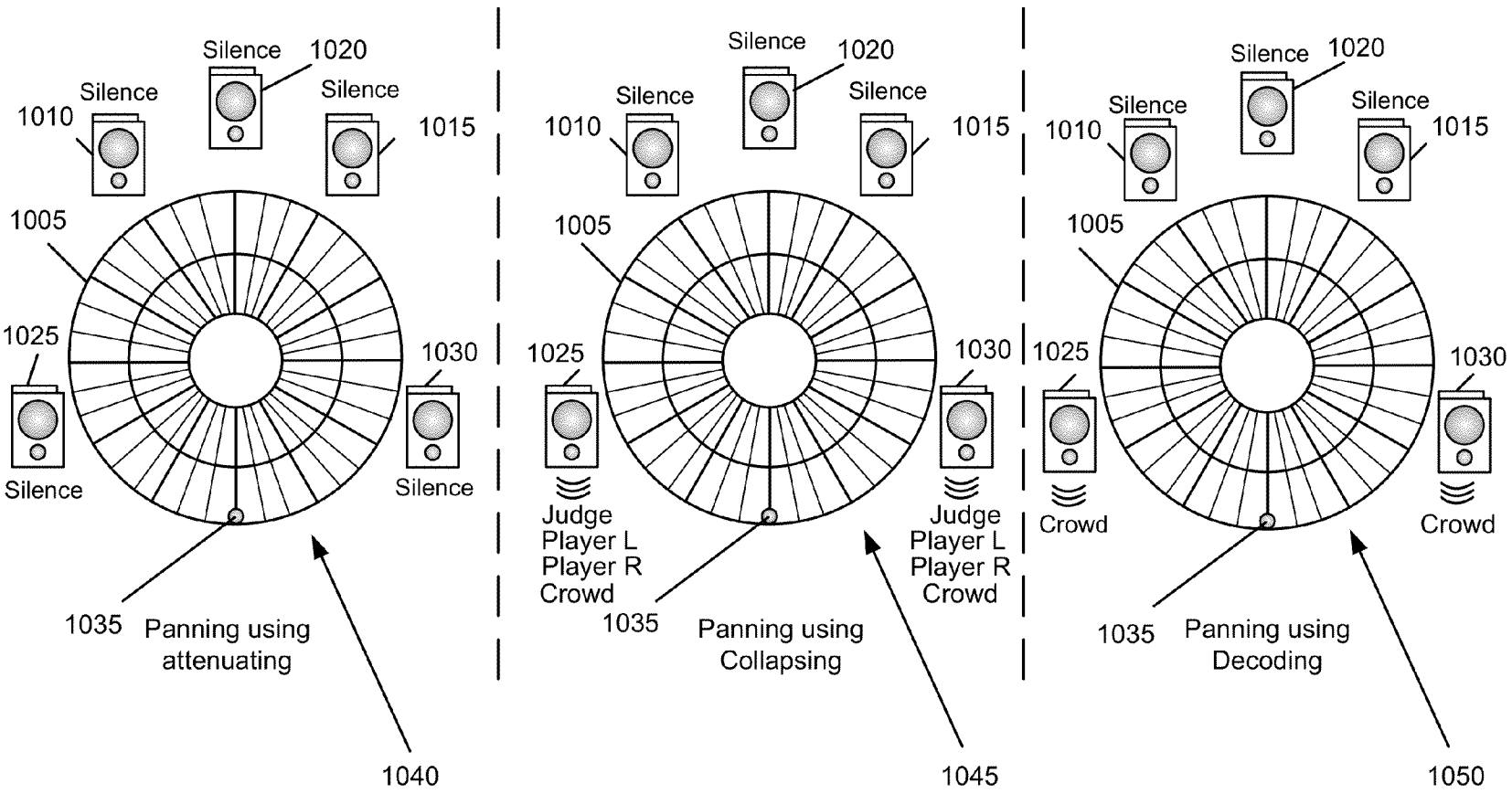
FIG. 10 illustrates an output sound space and the output channels at each speaker when the puck is at the center back (at 180° position) in the sound space.

FIGS. 8-10 conceptually illustrate the differences between panning using decoding according to the present invention versus panning using either attenuating or collapsing but without decoding. Each of these figures uses the tennis match scenario shown in FIG. 6 and a particular position of the puck.

FIG. 8 illustrates an output sound space 805 and the output channels at each speaker 810-830 when the puck 835 is at the front center (at 0° position) of the sound space 805. Typically, the puck 835 is placed in this position to emphasize the voice of the judge.

When only attenuating panning (and not decoding) is done (as shown by arrow 840), all speakers 810-830 are silent. Panning by attenuating does not relocate sound channels. Since the sound (as shown in FIG. 7) without panning and decoding was only directed to the left and right speakers, moving the puck 835 to front center would attenuate the sound on all speakers except the center (which was already silent). As a result, all speakers 810-830 are silent which is not a desired result.

When only collapsing panning (and not decoding) is done (as shown by arrow 845), all speakers except the center speaker 820 are silent. Panning by collapsing relocates all sound channels to where the puck 835 is directed. As a result, the center speaker plays sounds from all channels including the judge, left player, right player, and crowd. Since the center speaker 820 is usually used for the sounds at the center of the stage (in this case the voice of the judge), having all sounds including the crowd and the left and right players to come out of the center speaker is not desirable.

In contrast, when decoding is used (as shown by arrow 850), some embodiments utilize the panning input (which is the movement of the puck 835 to the front center) to decode the channels in a way that the judge's sound is heard on the center speaker while all other speakers 810-815 and 825-830 are silent. Specifically, the voice of the judge is separated from the sounds of the players and the crowd by doing the surround sound decoding. The resulting sounds are then panned to the front center speaker. As a result, the judge's sound is heard on the center speaker and other speakers are left silent.

FIG. 9 illustrates an output sound space 905 and the output channels at each speaker 910-930 when the puck 935 is at the left most position in the sound space 905. Typically, the puck 935 is placed in this position to emphasize the sound of the left player 610 on the left speaker 910 as well as the ambient sound from the crowd on the left surround speaker 925.

When only attenuating panning (and not decoding) is done (as shown by arrow 940), all speakers except the front left speaker 910 are silent. Since the sound (as shown in FIG. 7) without panning and decoding was only directed to the left and right speakers, moving the puck 935 to left most center would attenuate the sound on all speakers except the left front 910 and left surround 925 speakers (which was already silent). As a result, the left front speaker 910 receives the sounds from the judge, left player, and the crowd (same as what the left front speaker 710 was receiving in FIG. 7) which has the undesired effect of playing the judge and crowd on the left front speaker. Also, the crowd sound is not played on the left surround speaker.

When only collapsing panning (and not decoding) is done (as shown by arrow 945), the left front 910 and left surround 925 speakers receive sounds from all channels and other speakers 915-920 and 930 are silent. Therefore, panning using collapsing in this case has the undesired effect of playing the judge 625 and the left and right players (610 and 615, respectively) on the left surround speaker 925 and playing the judge 625, right player 615, and crowd 630 on the left front speaker 910.

In contrast, when decoding is used (as shown by arrow 950), some embodiments utilize the panning input (which is the movement of the puck 935 to the left most position) to decode the channels in a way that the left player's sound is played on the left front, the crowd is heard on the left surround speaker while all other speakers 915-920 and 930 are silent. Specifically, the voice of the left player and the crowd noise are separated from the other sounds by doing the surround sound decoding. The resulting sounds are then panned to the left. As a result, left player sound is sent to the left speaker 910, the crowd noise is sent to the left surround speaker 925, and other speakers are left silent.

FIG. 10 illustrates an output sound space 1005 and the output channels at each speaker 1010-1030 when the puck 1035 is at the center back (at 180° position) in the sound space 1005. Typically, the puck 1035 is placed in this position to emphasize the ambient sound (in this example the noise of the crowd 630) on the surround speakers 1025 and 1030.

When only attenuating panning (and not decoding) is done (as shown by arrow 1040), all speakers 1010-1030 are silent. Since the sound (as shown in FIG. 7) without panning and decoding was only directed to the left and right speakers, moving the puck 1035 to center back would leave all speakers silent which is not a desired result.

When only collapsing panning (and not decoding) is done (as shown by arrow 1045), the left surround 1025 and the right surround 1030 speakers receive sounds from all channels including the judge, left player, right player, and crowd which has the undesirable effect of hearing the sounds of the judge and left and right players on the surround speaker.

In contrast, when decoding is used (as shown by arrow 1050), some embodiments utilize the panning input (which is the movement of the puck 1035 to the center back position) to decode the channels in a way that left surround 1025 and the right surround 1030 speakers receive the crowd sound and all other speakers are silent. Specifically, the sounds are separated by doing surround sound decoding. The result is then panned to the center back which results in the crowd noise to be heard on the surround speakers 1025-1030.

As shown in the examples of FIGS. 8-10, panning attenuating yields total silence in many cases and collapsing folds too many channels into each speaker. In contrast, panning using decoding provides separation of the sounds, prevents folding of unwanted signals into one speaker, and preserves uniqueness of the sounds by preventing a sound signal to be sent to more than one speakers.

Figure 11:
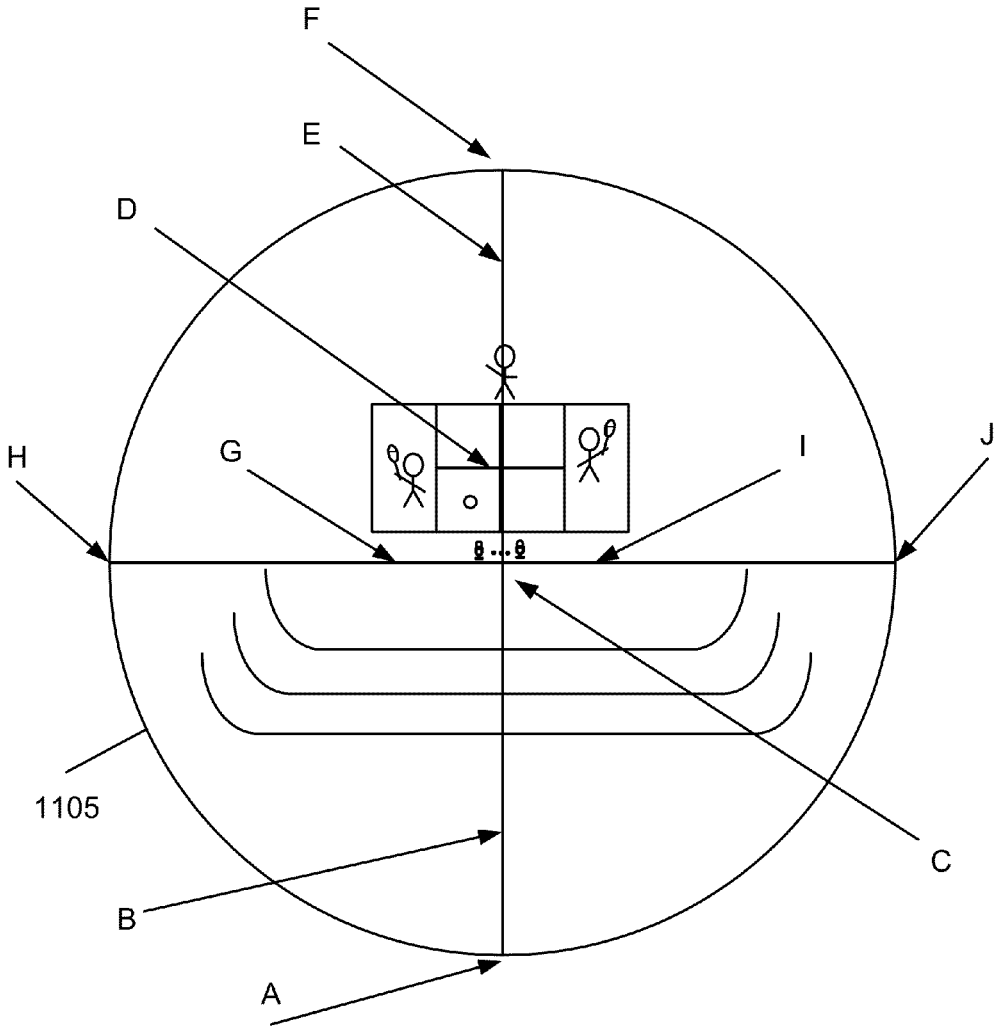
FIG. 11 shows the tennis example of FIG. 6 drawing in a sound space with different points in the sound space marked with letters A-J.

FIGS. 11 and 12 conceptually illustrate several more examples of the output of the panner of some embodiments that use different panning inputs. FIG. 11 shows the tennis example of FIG. 6 drawing in a sound space 1105. Different points in the sound space are marked with letters A-J. FIG. 12 conceptually illustrates panning inputs for decoding the input Lt and Rt channels in order to reproduce the sound in the output space that approximates the sound at different locations A-J of the input space.

Specifically, FIG. 12 shows a table that on the left column shows the locations A-J of FIG. 11 and a particular puck position 1205. For instance, the first row shows how the sound for location A is reproduced. The puck for position A is shown to be at the center front, the decode balance is at minus infinity, Ls/Rs width is set to 0 dB, and F/R bias is set at 0 dB.

The right most column shows the position of the five speakers according to position of speakers in any of FIGS. 7-10. Specifically, the position are left front 1210, right front 1215, center 1220, left surround 1225, and right surround 1230. On top of the line that represents each speaker position, the sound received at that speaker is displayed. The abbreviations J, Pl, Pr, Cl, Cr, and C over a speaker position correspond to the sound from the judge, left player, right player, crowd left, crowd right, crowd (both left and right) that are received at that speaker position. Also, abbreviations Lt and Rt over a speaker position indicate that all signals from Lt channel (in the example of FIG. 6 the judge, left player, and crowd) and Rt channel (judge, right player, and crowd) are received at that speaker. Also, abbreviations F and R over a speaker position indicate that the speaker receives the decoded front signal (in this case the decoded signal for center speaker) and the decoded rear signal (in this case the decoded signal for surround speakers).

For position A in the first row, the center speaker is shown to receive both Lt and Rt signals while all other four speakers are silent (as shown by number 0 above the lines that indicate the speaker positions). Similarly, other locations B-J in the input sound space are reproduced by proper settings of several panning and decoding inputs. Signals received at some speakers are weaker than the others. For instance, for position B, the Cl and Cr signals to surround speakers are weaker than Cl and Cr signals to the left and right front speakers due to the position of the puck between the center and front of the sound space.

As shown in FIG. 12, for position J mostly the undecoded signal Rt is provided to the left front and left surround speakers with some decoded front signal (F) to the front left and some decoded rear signal (R) to the left surround speaker. This is because at the extreme left position of the puck, the signals are collapsed to the left side speakers. Therefore, it is more desirable to send the unencoded signals to the speakers instead of first decoding the signals and then collapsing them to the speaker. Similarly, in position H, mostly the undecoded signal Lt is provided to the right front and right surround speakers with some decoded front signal (F) to the front right and some decoded rear signal (R) to the right surround speaker. This is because at the extreme right position of the puck, the signals are collapsed to the right side speakers. Therefore, it is more desirable to send the unencoded signals to the speakers instead of first decoding the signals and then collapsing them to the speaker. Accordingly, the panner in some embodiments utilizes the panning input information to properly reduce the amount of surround sound decoding when such decoding is undesirable.

The values for the decode balance, Ls/Rs width, and F/R bias parameters shown in FIG. 12 are derived from the following formulas:

$$\text{FR Bias}=-6y$$

$$\text{LsRs Width}=(x+1)^2+2$$

$$\text{Decoder Balance}=(1-x^2)-100(y^4)-6x$$

where x and y are the x and y coordinates of the panner within the unit circle. The panner then does a mixture of collapsing and attenuating in equations.

B. Different Decoding Techniques Used

In some embodiments, the surround sound decoder takes the panning parameters and uses them to adjust the formulas that are used to do the surround sound decoding. Some formula coefficients also change in time both independent from the panning inputs as well as in response to changing of panning parameters. For instance, some decoders specify the center signal as follows:

$$C=0.7(G*Lt+(1-G)*Rt)$$

$$G=\sqrt{\Sigma_{n=x-30}^{x}(Lt_n^2-Rt_n^2)*\lambda_n}$$

where the Σ operator sums the difference between the squares of Lt and Rt signals over a certain number of previous samples (in this example over 30 previous samples), x identifies the current sample, n is the index identifying each sample, and $\lambda_n$ denotes how fast the output signal level (i.e., the center signal, C) follows the changes of the input signals levels, i.e., Lt and Rt signals.

Using the above formulas allows compensating for the time varying signals. For instance, if overtime the left signal is louder, the above formula for C and G compensate for that. In some embodiments, the matrix formulas are dependent on the values of one or more of the panning and decoding parameters as well as the time. In these embodiments, changing the panning and/or decoding inputs adjusts the matrix and the quickness of the response to changes in the Lt and Rt signals.

Other embodiments use other formulas for surround sound decoding. For instance, the following program code is used in an embodiment that brings a louder channel down to the quieter channel. Specifically, the root-mean-square (RMS) of the right and left channels are compared and the channels are scaled based on the comparison. The output signals are then calculated using the scaled values.

```
// Calculate the RMS values into left and right scaled
leftRMS = squareroot ((lastLeftRMS^2 * (1-SpeedPARAMETER)) + (LeftINPUT^2 *
SpeedPARAMETER))
rightRMS = squareroot ((lastRightRMS^2 * (1-SpeedPARAMETER)) +
```

-continued

```
(RightINPUT^2 * SpeedPARAMETER))
// Bring the louder channel down to the quieter channel
if (leftRMS > rightRMS) LeftSCALED = LeftINPUT
    RightSCALED = RightINPUT * (rightRMS/leftRMS)
if (rightRMS > leftRMS) LeftSCALED = LeftINPUT * (leftRMS/rightRMS)
    RightSCALED = RightINPUT
// Calculate the output signals
CenterOUTPUT = (LeftSCALED + RightSCALED) * .707 * DecoderBalancePARAMETER *
FrontRearBiasPARAMETER
LeftOUTPUT = LeftINPUT * (1−DecoderBalancePARAMETER)
RightOUTPUT = RightINPUT * (1−DecoderBalancePARAMETER)
LeftSurrOUTPUT = (LeftSCALED − (RightSCALED * −LsRsWidthPARAMETER)) * .707 *
DecoderBalancePARAMETER * (1−FrontRearBiasPARAMETER)
RightSurrOUTPUT = (RightSCALED − (LeftSCALED * −LsRsWidthPARAMETER)) * .707 *
DecoderBalancePARAMETER * (1−FrontRearBiasPARAMETER)
```

Some embodiments perform additional enhancements during surround sound decoding. For instance, some embodiments delay the two surround outputs (e.g., the surround output would be ~10 milliseconds after the left, center, and right outputs). Some embodiments apply lowpass or bandpass filters to the scaled input signals or the center and surround outputs. Furthermore, some embodiments additionally keep a running RMS of the center and surround signals to be used to drive attenuators on the output channels.

Furthermore, the decoding algorithm of different embodiments run any number of other decoding algorithms, including but not limited to Dolby Surround Dolby Pro Logic, DTS Neural Surround™ UpMix, DTS Neo:6, TC Electronic|Unwrap HD, SRS Circle Surround II, and Lexicon LOGIC 7™ Overview.

Also, some embodiments utilize different ways of generating surround sound in addition (or instead) of a typical decoding. For instance, some embodiments generate surround content with a surround reverb. Other embodiments perform some other techniques for source reconstruction. In all these embodiments, the decoding is used in conjunction with panning to achieve more convincing and realistic placement of sound in a virtual surround field.

Figure 13:
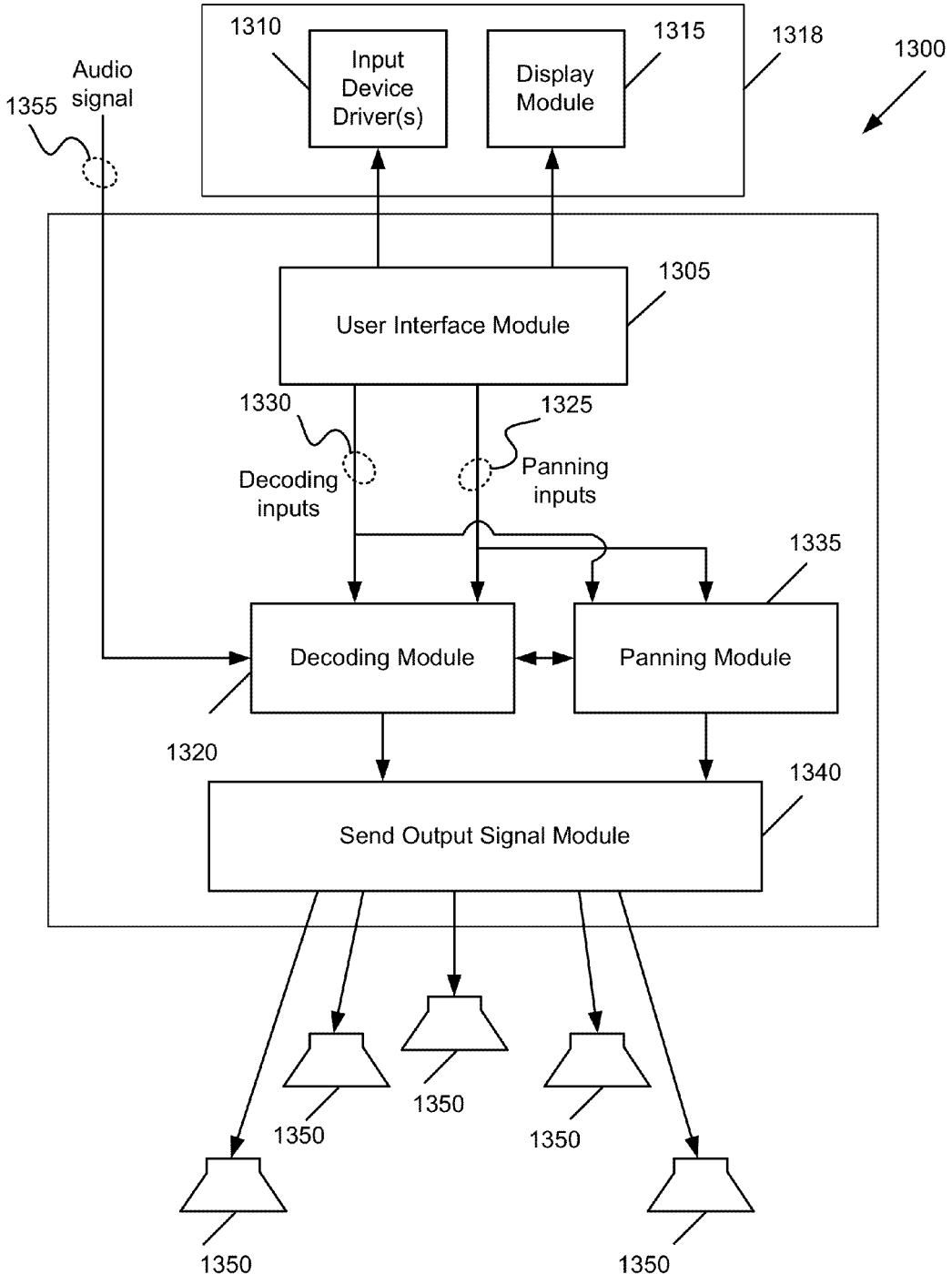
FIG. 13 conceptually illustrates the software architecture of an application for performing surround sound decoding using panning inputs in some embodiments.

FIG. 13 conceptually illustrates the software architecture of an application 1300 for performing surround sound decoding using panning inputs in a media editing application in some embodiments. As shown, the application includes a user interface module 1305, a decoding module 1320, a panning module 1335, and a module 1340 to send the signals to the output speakers 1350. The user interface module 1305 interacts with a user through the input device driver(s) 1310 and the display module 1315.

The user interface module 1305 receives panning parameters 1325 and decoding parameters 1330 (e.g., through the GUI 200). The user interface module passes the panning parameters 1325 and decoding parameters 1330 to the decoding module 1320 and panning module 1335. The panning module 1335 and the decoding module 1320 use one or more of the techniques described in this specification to generate the output audio signal from the received input audio signal 1355. The "send output signal "module" sends the output audio signal to a set of speakers 1350 (five are shown).

FIG. 13 also illustrates an operating system 1318. As shown, in some embodiments, the device drivers 1310 and display module 1315 are part of the operating system 1318 even when the media editing application is an application separate from the operating system. The input device drivers 1310 may include drivers for translating signals from a keyboard, mouse, touchpad, drawing tablet, touchscreen, etc. A user interacts with one or more of these input devices, which send signals to their corresponding device driver. The device driver then translates the signals into user input data that is provided to the user interface module 1305.

The present application describes a graphical user interface that provides users with numerous ways to perform different sets of operations and functionalities. In some embodiments, these operations and functionalities are performed based on different commands that are received from users through different input devices (e.g., keyboard, trackpad, touchpad, mouse, etc.). For example, in some embodiments, the present application uses a cursor in the graphical user interface to control (e.g., select, move) objects in the graphical user interface. However, in some embodiments, objects in the graphical user interface can also be controlled or manipulated through other controls, such as touch control. In some embodiments, touch control is implemented through an input device that can detect the presence and location of touch on a display of the input device. An example of a device with such a functionality is a touch screen device (e.g., as incorporated into a smart phone, a tablet computer, etc.). In some embodiments with touch control, a user directly manipulates objects by interacting with the graphical user interface that is displayed on the display of the touch screen device. For instance, a user can select a particular object in the graphical user interface by simply touching that particular object on the display of the touch screen device. As such, when touch control is utilized, a cursor may not even be provided for enabling selection of an object of a graphical user interface in some embodiments. However, when a cursor is provided in a graphical user interface, touch control can be used to control the cursor in some embodiments.

III. Rigging of Parameters to Facilitate Coordinated Panning and Decoding

Figure 14:
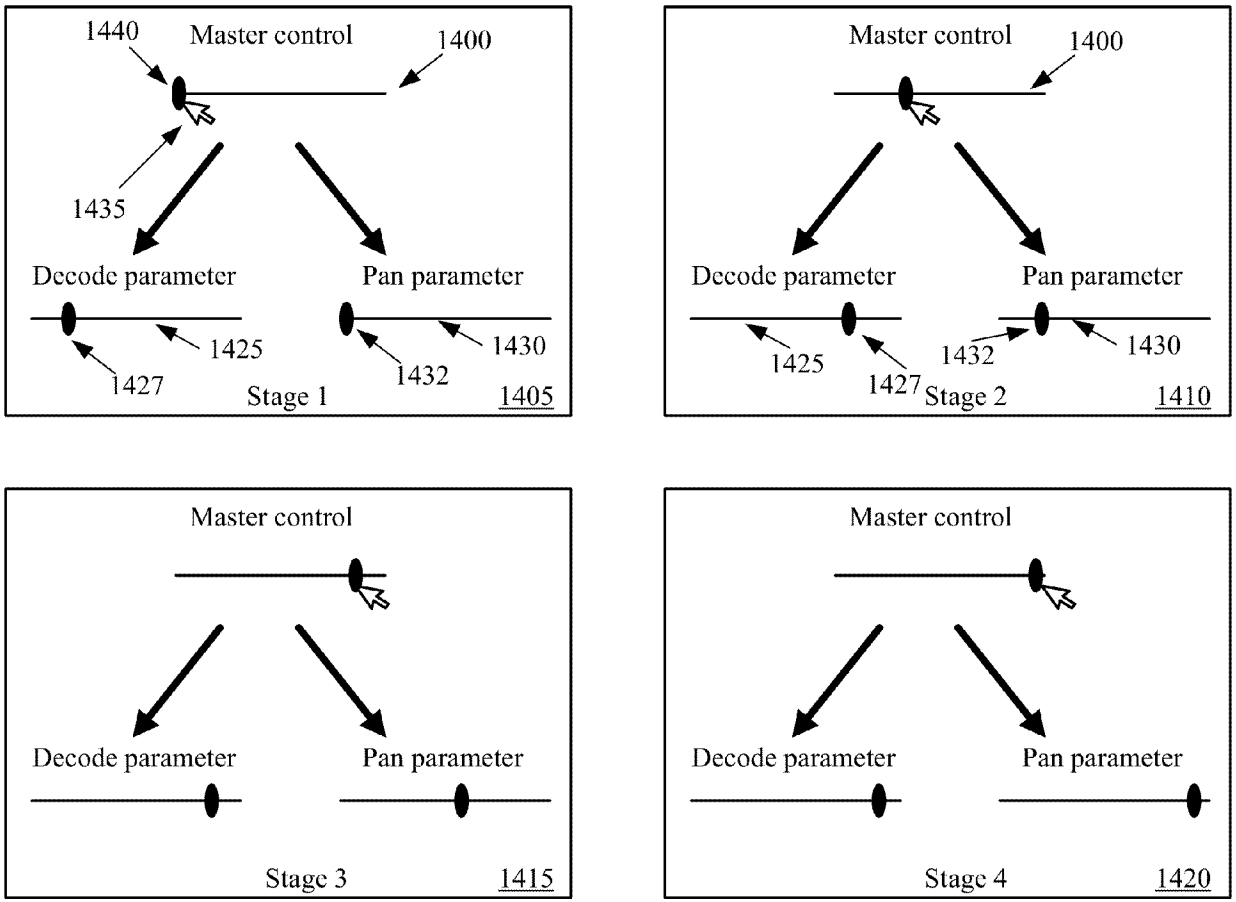
FIG. 14 conceptually illustrates a master control that adjusts the values of both panning and decoding subordinate controls in some embodiments.

In some embodiments, one or more parameters are used to control a larger set of decode and/or panning parameters. FIG. 14 conceptually illustrates a master control that adjusts the values of both panning and decoding subordinate controls. As an example, a master control in some embodiments is slider 220 and subordinate controls are any of panning parameters 265 or decoding parameters 260 shown in FIG. 2. FIG. 14, however, provides a conceptual overview of such a master control and subordinate controls, rather than specific details of actual controls. The master control 1400 is illustrated at four settings in four different stages 1405-1420. The figure includes master control 1400 with a knob 1440, decode parameter control 1425 with knob 1427, and pan parameter control 1430 with knob 1432. The selection is received through a user selection input 1435 such as input received from a cursor controller (e.g., a mouse, touchpad, trackpad, etc.), from a touchscreen (e.g., a user touching a UI item on a touchscreen), etc. The term user selection input is used throughout this specification to refer to at least one of the preceding ways of making a selection, moving a control, or pressing a button through a user interface. The master control 1400 is an adjustable control that determines the settings of a decode parameter and a pan parameter. The decode parameter control 1425 graphically displays the current value of the decode parameter. The pan parameter control 1430 graphically displays the current value of the pan parameter.

The master control of some embodiments is a slider control. In stage 1 (1405) the master control 1400 has been set to a minimum value (at the far left of the slider) by the user selection input 1435. Stage 1 (1405) illustrates the values of the decode and pan controls when the master control 1400 is set to a minimum value. In the illustrated embodiment, the minimum value for the master control 1400 corresponds to a minimum value of the pan parameter. This minimum value of the pan parameter is shown by indicator 1430 with knob 1432, which is at the far left end of the indicator.

In this figure, the minimum value of the master control 1400 corresponds to the minimum possible value of the panning parameter. However, some embodiments provide master controls 1400 whose minimum values do not necessarily correspond to the minimum possible values of the subordinate parameters. FIG. 14 includes such a subordinate parameter as shown by the relationship between the master control 1400 and the decode parameter indicator 1425. In this case, the minimum value for the master control 1400 corresponds to a value of the decode parameter that is slightly above the minimum possible value of the decode parameter. This low (but not minimum) value of the decode parameter is shown by indicator 1425 with knob 1427, which is slightly to the right of the far left end of the decode parameter indicator 1425.

Stage 2 (1410) shows the values of the decode and pan parameters at an intermediate value of the master control 1400. Stage 2 (1410) demonstrates that some embodiments adjust different parameters by disproportionate amounts when the setting of the master control 1400 increases by a particular amount. The master control 1400 is set at an intermediate value (at about a third of the length of the master control slider). The decode parameter (as shown by knob 1427 of decode parameter indicator 1425) has increased considerably in response to the relatively small change in the master control's 1400 setting. However, the pan parameter (as shown by knob 1432 of decode parameter indicator 1430) has increased only slightly in response to that change in the master control's 1400 setting. That is, the small increase in the setting of the master control 1400 results in a large increase in one subordinate parameter and a small increase in another subordinate parameter.

Stage 3 (1415) shows the values of the decode and pan parameters at a large value of the master control. Stage 3 (1415) demonstrates that the master control can set the subordinate parameters in a non-linear manner. In this stage, the decode parameter has increased only slightly compared to its value in stage 2 (1410) even though the setting of the master control has gone up considerably. This contrasts with the large increase of the decode parameter from stage 1 (1405) to stage 2 (1410) when the master control setting went up only slightly. In stage 3 (1415) the pan parameter has increased proportional to the change in the master control's setting. Demonstrating that in some embodiments one parameter (here, the panning parameter) can have a linear relationship to the master control over part of the range of the master control even while another parameter (here the decode parameter) is non-linear over that range.

Stage 4 (1420) shows the values of the decode parameter and panning parameter when he master control's setting is at maximum. The master control's setting has gone up slightly compared to the setting in stage 3 (1415). The decode parameter has gone up very slightly, while the pan parameter has gone up significantly. The large increase in the panning parameter demonstrates that a parameter can have a linear relationship to the master control's setting for part of the range of the master control, but the same parameter can have a non-linear relationship to the master control's setting for another part of the range of the master control.

Although FIG. 14 shows only one master control and two subordinate parameters, different number of subordinate parameters are rigged to a master control in different embodiments. Furthermore, in some embodiments several master controls are rigged to several sets of subordinate parameters in order to create several different effects. In some of these embodiments, the same subordinate parameter is rigged to multiple master controls.

Figure 15:
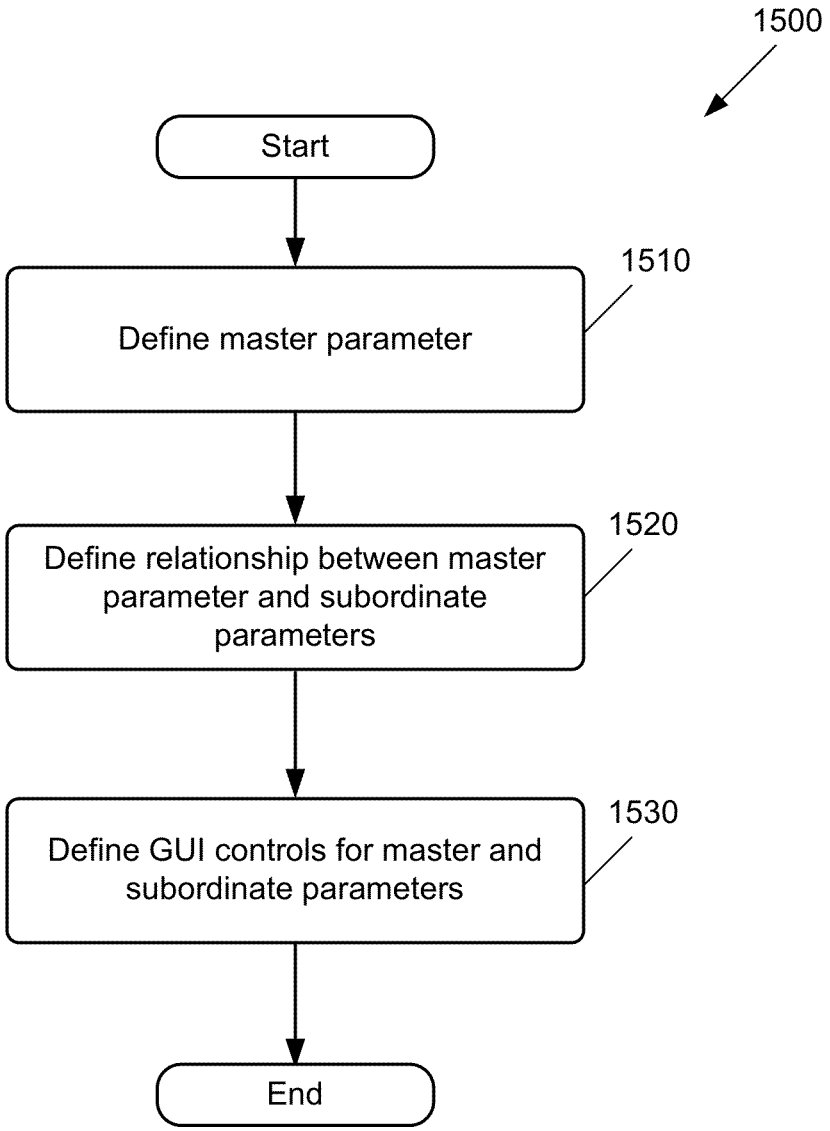
FIG. 15 conceptually illustrates a process of some embodiments for setting relationships between master parameters and subordinate parameters.

FIG. 15 conceptually illustrates a process 1500 of some embodiments for setting relationships between master parameters and subordinate parameters. Process 1500 is a general description of the processes of some embodiments. The processes of several more specific processes for setting relationships between master parameters and subordinate parameters are described further below. As shown, the process begins by defining (at 1510) a master parameter. Defining a master parameter includes naming the parameter in some embodiments. In some embodiments, defining the master parameter also includes setting a maximum and minimum allowable value for the master parameter. The process 1500 then defines (at 1520) the relationship between the master parameter and the subordinate parameters. For example, the process 1500 defines a value for each of one or more subordinate parameters for each value of the master parameter in some embodiments. In other embodiments, the process 1500 defines a value for each of one or more subordinate parameters for a subset of the possible values of the master parameter.

The process defines (at 1530) GUI controls for the master and subordinate parameters. In some embodiments, defining GUI controls for the master includes assigning the master parameter to an existing control (e.g., an existing slider) in a particular display area of the GUI. The GUI controls for the subordinate parameters of some embodiments are designed to be indicators of the values of the subordinate parameters as set by the GUI control for the master parameter. As mentioned in the preceding paragraph, process 1500 of some embodiments defines a value for each of one or more subordinate parameters for a subset of the possible values of the master parameter. In some embodiments, when a program (not shown) implements the GUI controls for such embodiments, the program determines the values of the subordinate parameters based on the defined values. When the GUI control for the master parameter is set between two parameters for which subordinate parameter values are defined, some such programs determine the subordinate parameter values by interpolating the set values. Once the process 1500 defines (at 1530) the GUI controls, the process ends.

Although process 1500 utilizes a master control and a set of subordinate controls, some embodiments do not require a master control to control the set of subordinate parameters. In these embodiments, a set of parameters are rigged together and changing any of these parameters changes the other parameters. Similarly, all discussions for FIG. 14-24 are also implemented in some embodiments without using a dedicated master parameter. Any of the rigged parameters is used in these embodiments to change or control the values of the other parameters. Creation of audio/visual effects is further described in U.S. patent application Ser. No. 13/151,199 entitled "Panning Presets", filed concurrently with this application, now published as U.S. Patent Publication 2012-0207309, which is incorporated herein by reference.

One of ordinary skill in the art will recognize that process 1500 is a conceptual representation of the operations used to setting relationships between master parameters and subordinate parameters. The specific operations of process 1500 may not be performed in the exact order shown and described. The specific operations may not be performed in one continuous series of operations, and different specific operations may be performed in different embodiments. Furthermore, the process could be implemented using several sub-processes, or as part of a larger macro process.

Figure 16:
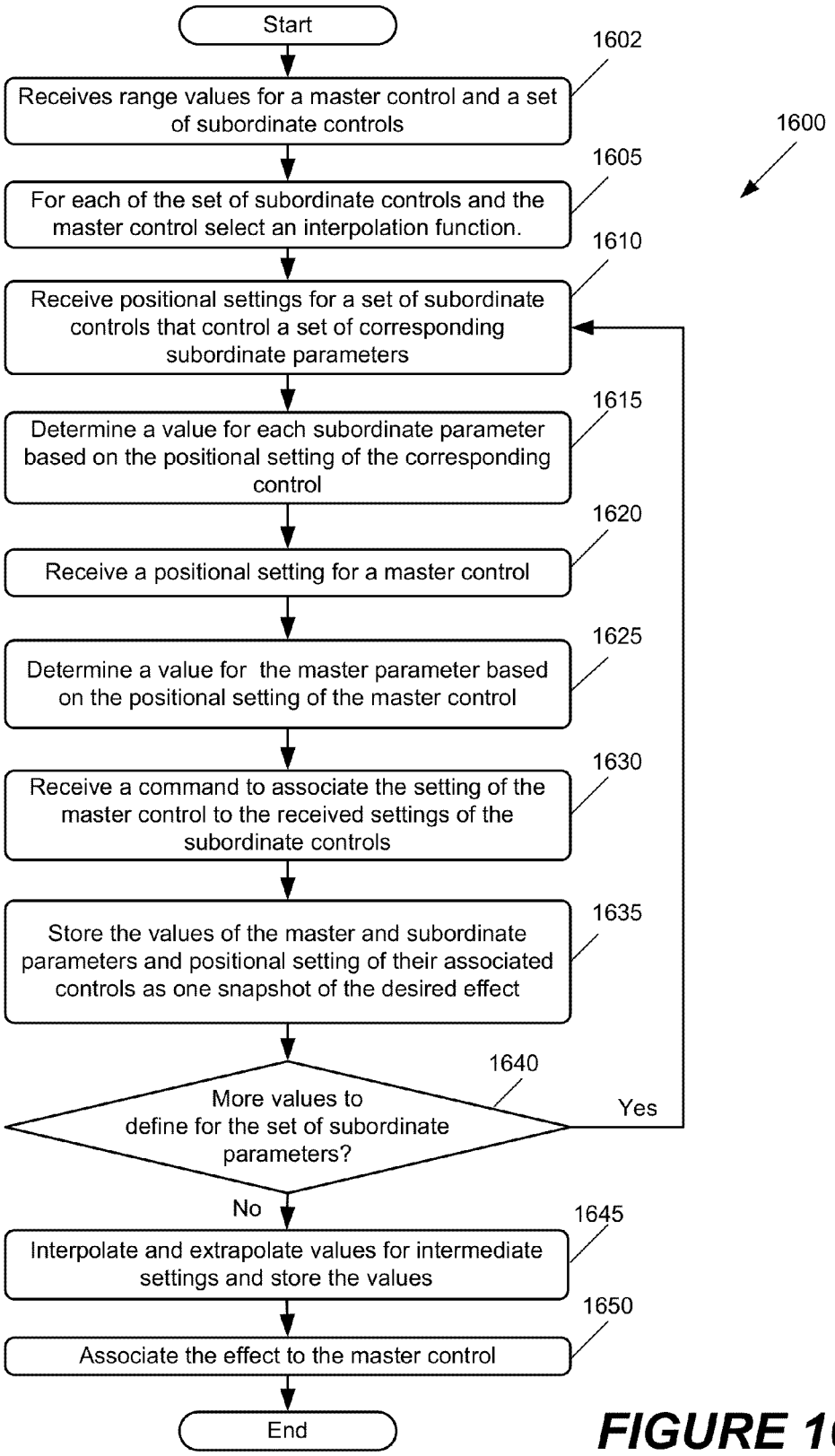
FIG. 16 conceptually illustrates a process of some embodiments for rigging a set of subordinate parameters to a master control.

FIG. 16 conceptually illustrates a process 1600 of some embodiments for rigging (i.e., tying together) a set of subordinate parameters to a master control to create a desired effect. For instance, during the design phase of GUI 200 (which is a GUI used by end users), a designer of the GUI might wish to add a "Fly from Right Surround to Center" effect and add it to the list of effects selectable by the control 250 (assuming that such an effect already does not exist or the effect exists but needs to be modified). The designer uses GUI 1700 shown in FIG. 17 to identify a set of desired values of subordinate parameters to a value of a master parameter.

Figure 17:
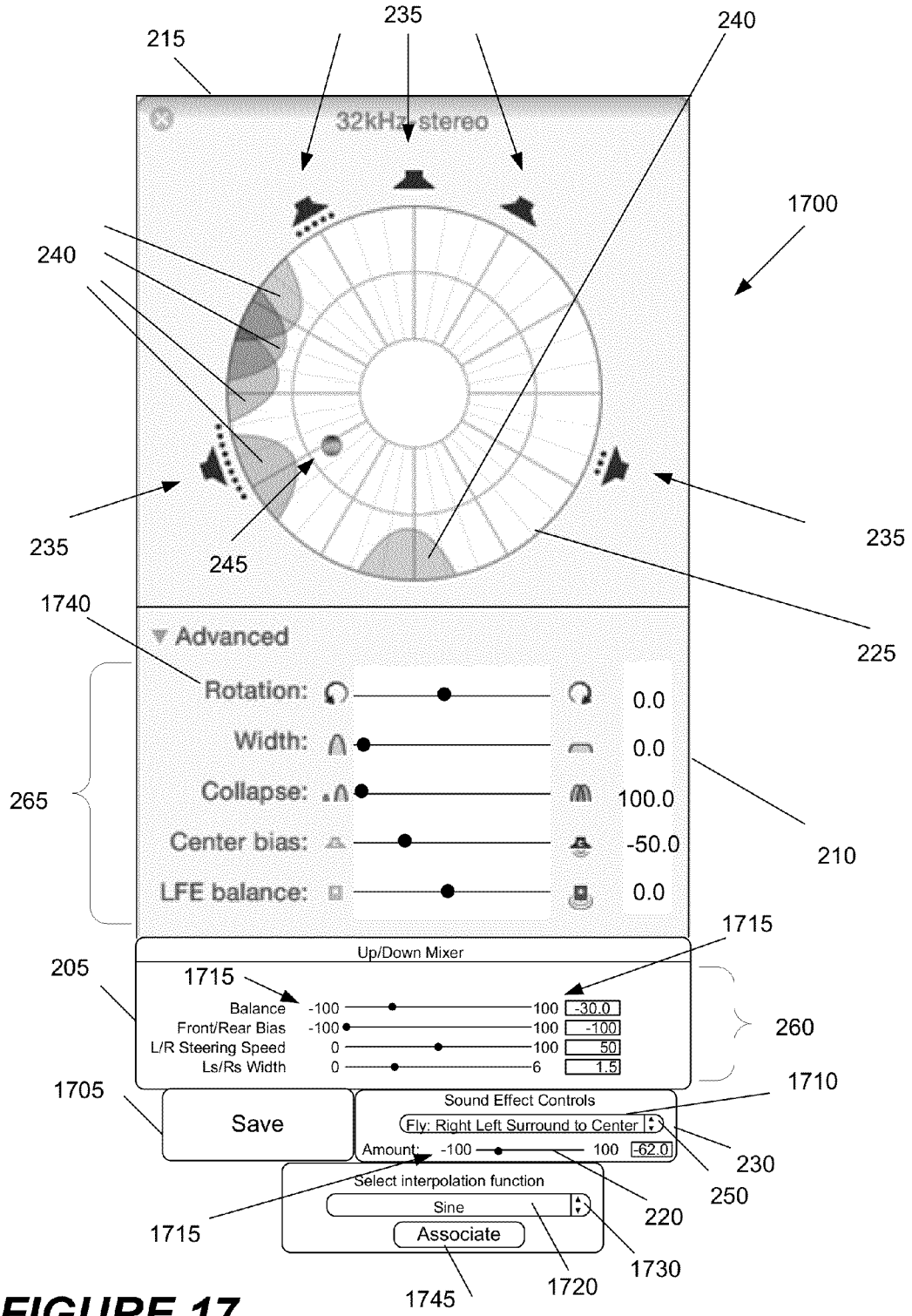
FIG. 17 illustrates a GUI that is used in some embodiments to generate values for master and subordinate controls to rig.

FIG. 17 illustrates a GUI 1700 of a media editing application in some embodiments that utilizes process 1600 to generate values for master and subordinate controls to rig. As shown, GUI 1700 includes similar controls as the runtime GUI 200. In addition, the GUI of FIG. 17 allows the designer to change the values of different panning and decoding parameters by moving their associated controls to create and save a desired effect. The GUI also allows the designer to change the range values of the master and subordinate parameters. The GUI also enables the designer to either select an existing effect through control 250 or enter a name for a new effect into text field 1710. The GUI also enables the designer to select individual controls and select an interpolation function for the selected control by using control 1730 that displays a list of available functions in the field 1720. In some embodiments, a new interpolation/extrapolation function can be entered in the text field 1720. Selecting the associate button 1745 associates an interpolation/extrapolation function with a selected control. The GUI also includes a save button 1705 to save the rigged values as described below. The values and information collected through GUI 1700 allows a GUI designer to add effects for a runtime GUI such as GUI 200 of FIG. 2 for use by an end user such as a movie editor.

Referring back to FIG. 16, process 1600 optionally receives (at 1602) range values for the master control and a set of subordinate controls. For instance, a designer enters new minimum and maximum range values by entering new values in the text fields 1715 associated with range value of each control.

Process 1600 then receives (at 1605) an interpolation function for interpolating values of parameters associated to each of a set of subordinate controls and a master control that are going to be rigged. In some embodiments, the GUI designer selects each control individually. For instance, a GUI designer selects the control for rotation parameter 1740. The designer then selects an interpolation function from a list of interpolation functions (e.g. a sine function 1720) by using control 1730. Process 1600 receives the interpolation function when the designer selects the associate button 1745 to associate the selected function to the selected control. The function is then used to determine values of each parameter based on the position of the associated controls as described below. The function is also used to interpolate values of parameters as described below. In some embodiments, process 1600 receives the interpolation function when the user enters a mathematical formula for the interpolation function through the text field 1720 and selects the associate button 1745.

Next, process 1600 receives (at 1610) positional settings for a set of subordinate controls that control a set of corresponding subordinate parameters. Referring to FIG. 17, the settings the subordinate parameters are determined by e.g., moving the puck 245 or moving any control associated with decoding parameters 260 and panning parameters 265.

Process 1600 then determines (at 1615) a value for each subordinate parameter based on the positional setting of the corresponding control. For instance, each value of the parameter "Balance" in display area 205 of FIG. 17 corresponds to a certain position of an associated slider. For example, a value of −100 for the Balance parameter corresponds to an extreme left position for the corresponding slider and a value of 100 is associated with an extreme right position for the slider. Other intermediate values are either set by moving the corresponding slider control to a new position or determined using the interpolation function associated with Balance parameter. In some embodiments, the received values correspond to one setting for each of the available subordinate parameters. For example, in embodiments with five decoding parameters and ten panning parameters, the received values include values for each of the fifteen parameters. In these embodiments, when an effect does not require the value of a particular parameter to change, the value of the particular parameter is kept constant. In other embodiments, the received values do not include values for all available panning and decoding parameters. For instance, a specific effect might rig only a few panning and decoding parameters to a master parameter.

Next, process 1600 receives (at 1620) a positional setting for a control that controls the master parameter. For instance, the process receives a value after a user selection input positions master control 220 in FIG. 17 at a new position. The process then determines (at 1625) a value for the master parameter based on the positional setting of the master control and the interpolation function associated with the master parameter. The master control may be control 220 or a new control to be added to the GUI. The value of the master parameter would be a value in between the two ranges of the values controlled by the master control (e.g., a value between −100 to +100) and the positional setting of the master control would be a position along the line that the slider 220 moves.

The process then receives (at 1630) a command to associate (or rig) the setting of the master control to the values of the set of subordinate parameters. For instance, in some embodiments when the save button 1705 is selected through a user selection input, process 1600 receives a command to associate (rig) the setting of the master control to the values of the selected subordinate parameters. The process stores (at 1635) the values of the master and subordinate parameters and the positional settings of their associated controls as one snapshot of the desired effect.

The process then determines (at 1640) whether another snapshot of the values is required. If so, the process proceeds to 1610 to receive another set of values for the master and subordinate parameters. Otherwise, the process optionally interpolates or extrapolates (at 1645) values of each parameter received to calculate intermediate values for the parameters. The process uses the interpolation function that is associated with each control. For instance when a master control parameter setting of 0 is associated with a subordinate control parameter setting of 6 and a master control parameter setting of 10 is associated with a subordinate control parameter setting of 12, then process 1600 (when a linear interpolation function is associated to the subordinate control) automatically associates a master control parameter setting of 5 (i.e., halfway between the received master control parameter settings) with a subordinate control parameter of 9 (i.e. halfway between the received subordinate control settings). Similarly, when interpolation function is non-linear (e.g., a sine function, a Bezier curve, etc.) the non-linear function is used to calculate the interpolated and extrapolated values. The process stores these values along with the received values of snapshots to create the desired effect.

The process then receives a name for the effect and associates (at 1650) the effect and the snapshot values to the master control. Referring to FIG. 17, process 1600 receives the name of the effect when the designer enters a name for the effect into text field 1710 (or selects an existing name using control 250 to modify the existing snapshots of the effect). The process then ends.

One of ordinary skill in the art will recognize that process 1600 is a conceptual representation of the operations used for rigging a set of subordinate parameters to a master control to create a desired effect. The specific operations of process 1600 may not be performed in the exact order shown and described. The specific operations may not be performed in one continuous series of operations, and different specific operations may be performed in different embodiments. Furthermore, the process could be implemented using several sub-processes, or as part of a larger macro process.

Figure 18:
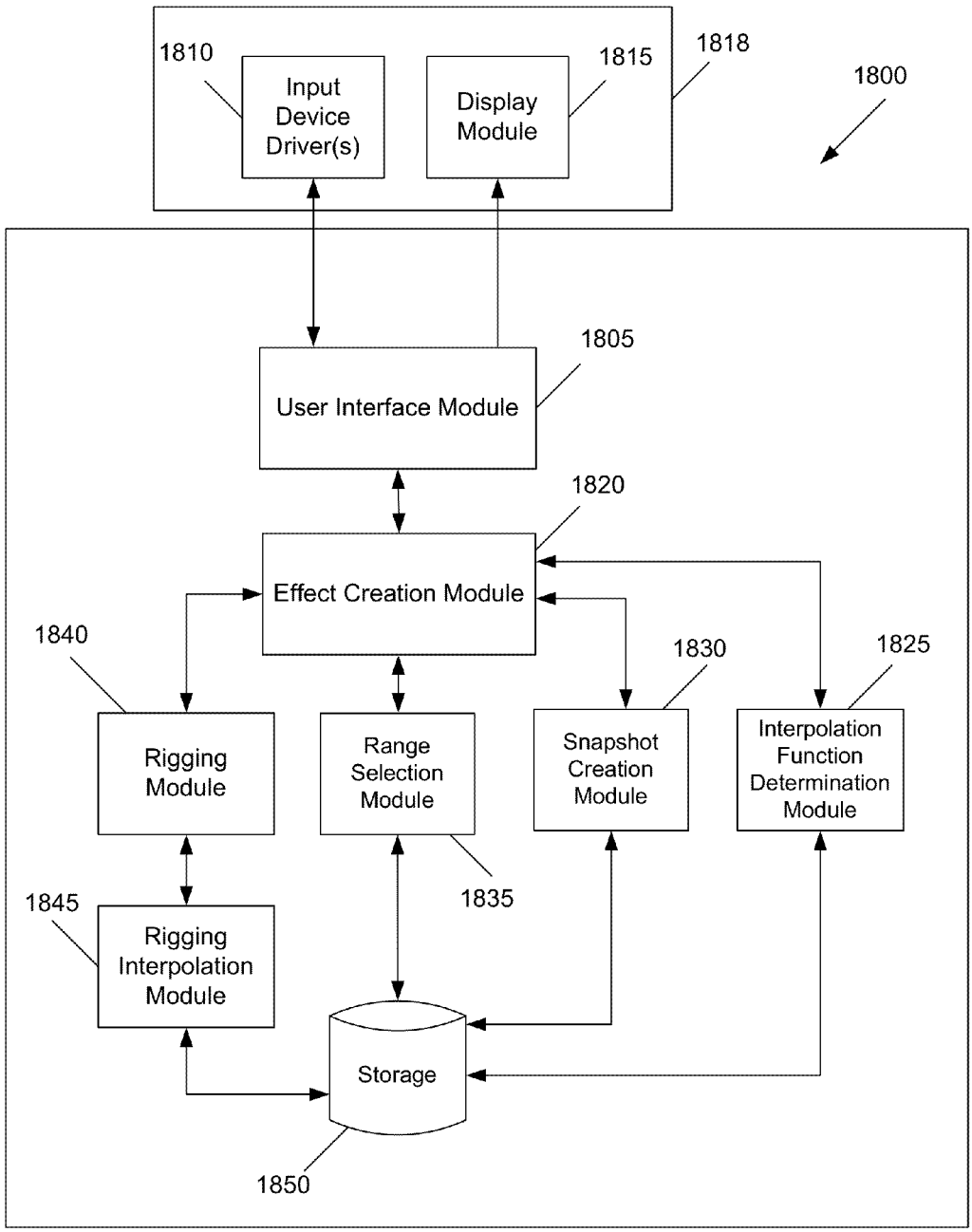
FIG. 18 illustrates a software architecture diagram of some embodiments for setting relationships between master controls and subordinate controls.

FIG. 18 conceptually illustrates the software architecture 1800 of an application for setting relationships between master controls and subordinate controls in a media editing application in some embodiments. As shown, the application includes a user interface module 1805, an effect creation module 1820, an interpolation function determination module 1825, a snapshot creation module 1830, a range selection module 1835, a rigging module 1840, and a rigging interpolation module 1845. The user interface module 1805 interacts with a user (e.g., a GUI designer) through the input device driver(s) 1810 and the display module 1815. FIG. 18 also illustrates an operating system 1818. As shown, in some embodiments, the device drivers 1810 and display module 1815 are part of the operating system 1818 even when the media editing application is an application separate from the operating system. The input device drivers 1810 may include drivers for translating signals from a keyboard, mouse, touchpad, drawing tablet, touchscreen, etc. A user interacts with one or more of these input devices, which send signals to their corresponding device driver. The device driver then translates the signals into user input data that is provided to the user interface module 1805.

The effect creation module 1820 receives inputs from user interface module and communicates with interpolation function determination module 1825, snapshot creation module 1830, range selection module 1835, and rigging module 1840. Interpolation function determination module 1825 receives the interpolation function associated with each control when the interpolation function is selected (either by entering a formula through the text field 1720 or by selection of an existing function through control 1720) and associate button 1745 is selected through a user selection input. Interpolation function determination module saves the interpolation function associated with each control into storage 1850. In some embodiments, a default linear interpolation function is assigned by the interpolation function determination module 1825 to each control prior to receiving an interpolation function for the control.

Snapshot creation module 1830 receives and saves values of the master and subordinate parameters for each snapshot. Range selection module 1835 receives the minimum and maximum range values for each control. Rigging module 1840 rigs the values of master and subordination controls. In some embodiments, rigging module 1840 communicates with rigging interpolation module 1845 to calculate additional snapshots by interpolating values of snapshots generated by snapshot creation module 1830. Storage 1850 is used to store and retrieve values of different ranges and parameters.

Figure 19:
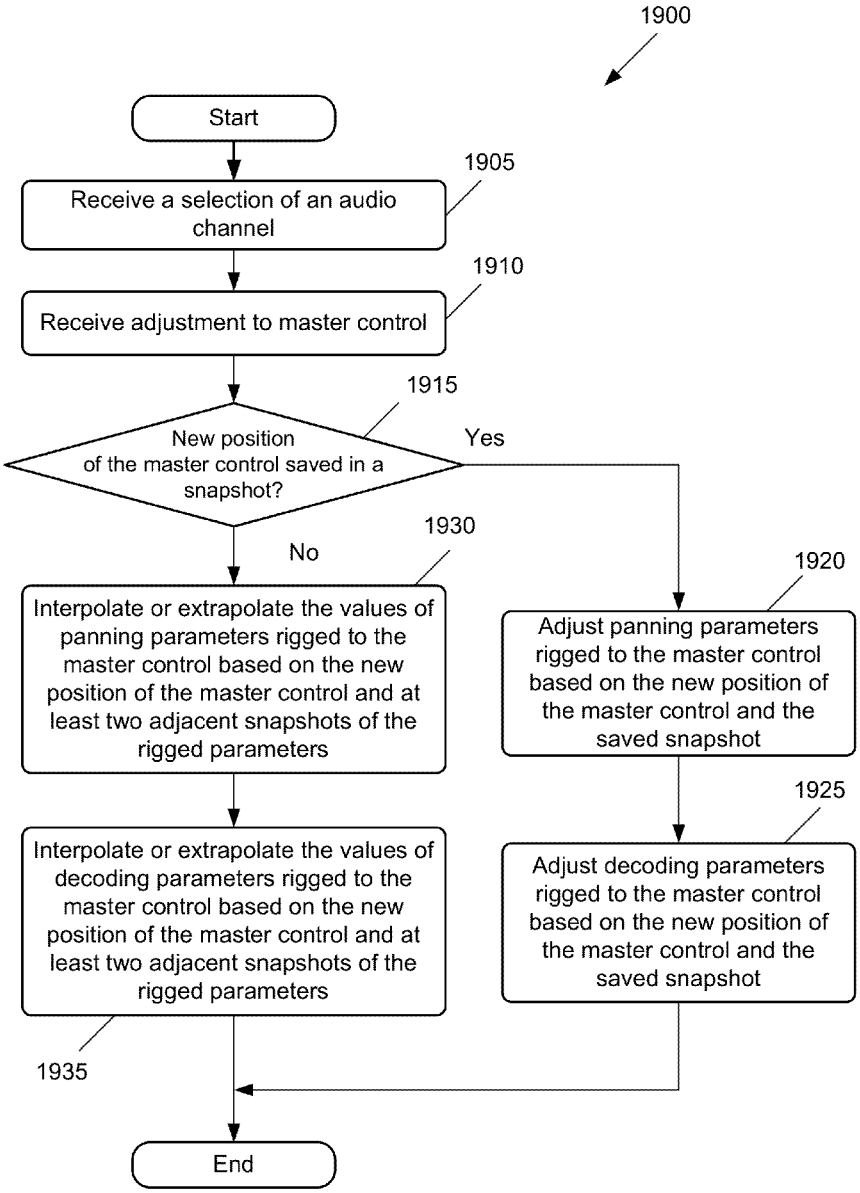
FIG. 19 conceptually illustrates a process for using a master control to apply an effect to an audio channel in some embodiments.

FIG. 19 conceptually illustrates a process 1900 for using a master control to apply an effect to an audio channel in some embodiments. As shown, the process receives (at 1905) a selection of an audio channel. In some embodiments, the audio channel is part of a media clip that includes either audio content or both audio and video content. The process then receives (at 1910) adjustment to a position of a master control. For instance, process 1900 receives an adjustment to the master control when a user of GUI 200 changes the position of the knob 270 of the master control.

Next, process 1900 determines (at 1915) whether the new position of the master control was saved in a snapshot of the rigged values. As was described by reference to FIG. 16, some embodiments save snapshots of the rigged values of the master control and subordinate parameters. When the new position matches the value of a saved snapshot, the process adjusts (at 1920) the panning parameters rigged to the master control based on the new position of the master control and the values saved in the snapshot for the rigged panning parameters. The process also changes the position of the associated controls for the rigged subordinate parameters. The process then adjusts (at 1925) the decoding parameters rigged to the master control based on the new position of the master control and the values saved in the snapshot for the rigged decoding parameters. The process also changes the position of the associated controls for the rigged subordinate parameters. The process then ends.

When the new position of the master control is not saved in a snapshot, the process interpolates (or extrapolates) (at 1930) the values of the panning parameters rigged to the master control based on the new position of the master control, at least two saved adjacent positions of the master control, and the values of the rigged parameters corresponding to the saved adjacent master control positions. The process also changes the position of the associated controls for the rigged subordinate parameters.

Next, the process interpolates (or extrapolates) (at 1935) the values of the decoding parameters rigged to the master control based on the new position of the master control, at least two saved adjacent positions of the master control, and the values of the rigged parameters corresponding to the saved adjacent master control positions. The process also changes the position of the associated controls for the rigged subordinate parameters. The process then ends.

In some embodiments, in addition to receiving adjustments to master control (as shown in operation 1910), process 1900 receives adjustments to one or more rigged panning and/or decoding parameters. In some of these embodiments, such an adjustment takes the adjusted parameter out of the rig. In other embodiments, such an adjustment stops rigging all other parameters as well. Yet in other embodiments, such an adjustment does not take the adjusted parameter out of the rig but offsets the value of the adjusted parameter. These embodiments allow a user to modify the rig by offsetting the values of the rigged parameters.

Figure 20:
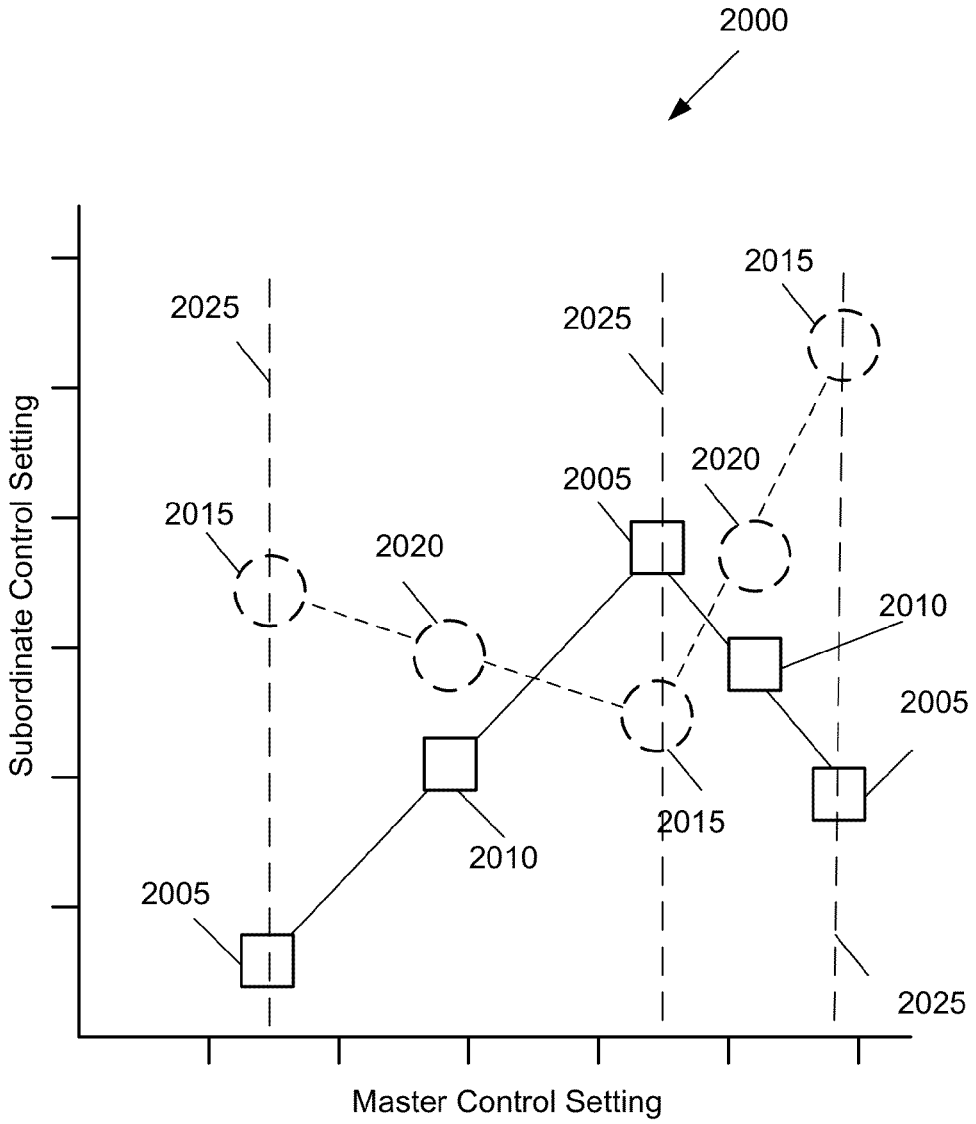
FIG. 20 illustrates a graph of rigged values in some embodiments where the rigged values of snapshots of master and subordinate parameters are interpolated to derive interpolated values.

FIG. 20 conceptually illustrates a graph 2000 of rigged values in some embodiments where the values 2005 of rigged parameters saved in snapshots are interpolated to derive interpolated values 2010. As shown, the graph 2000 depicts the values of a rigged parameter (y-axis) versus the setting of a rig control (x-axis) such as a slider position.

Values of parameters shown on vertical lines 2025 are the saved snapshot values. The "in between" values 2010 are interpolated using a linear interpolation function that interpolates the values 2005 saved in snapshots. Similarly, the values 2015 of another rigged parameter are interpolated to derive interpolated values 2020.

Figure 21:
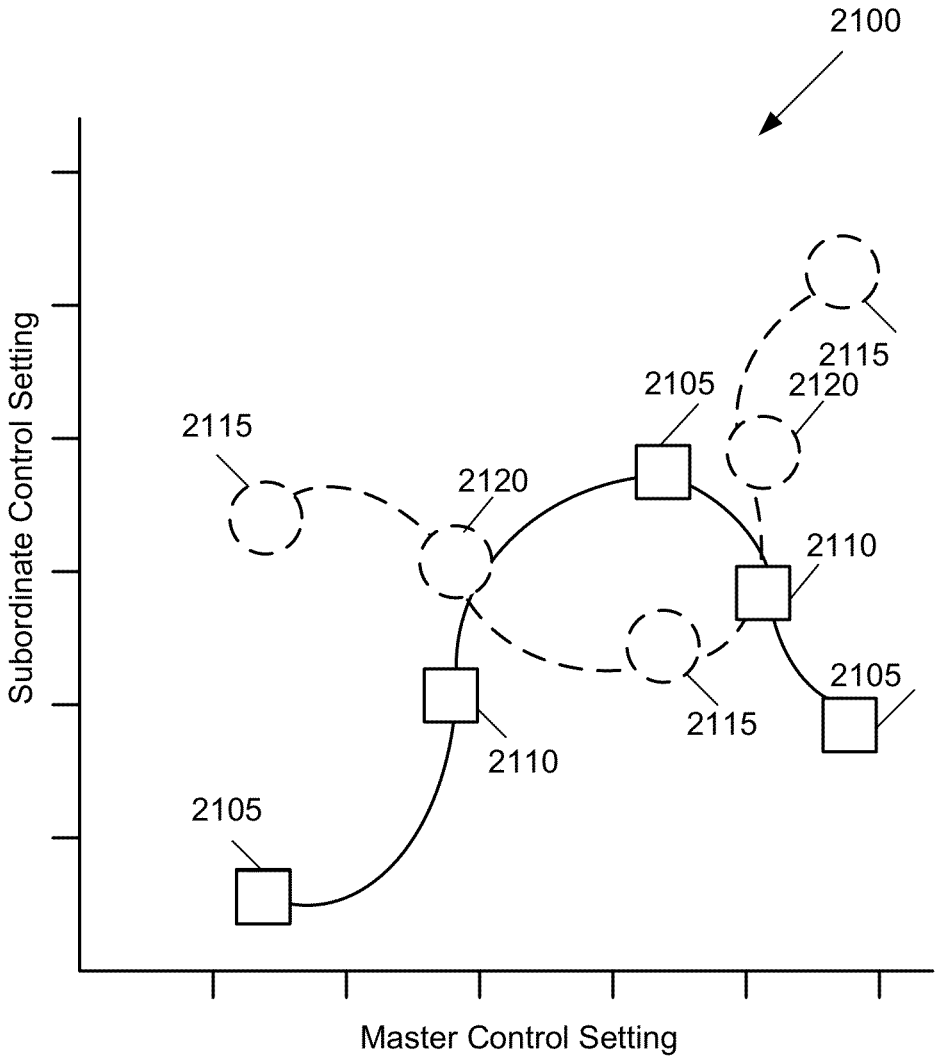
FIG. 21 illustrates an alternate embodiment in which the interpolated values provide a smooth curve rather than just being a linear interpolation of the nearest two rigged values.

FIG. 20 illustrates a linear interpolation between the values saved in snapshots. Some embodiments utilize non-linear functions to perform interpolation. In some embodiments, the interpolation function is user selectable and the user selects (or enters) a desired interpolation function for a particular rig. FIG. 21 conceptually illustrates a graph 2100 of rigged values of an alternate embodiment in which the interpolated values 2110 provide a smooth curve rather than just being a linear interpolation of the nearest two rigged values 2105. In this embodiment a non-linear interpolation function is used to derive the "in between" values 2110 or 2120 from the values 2105 and 2115 that are saved for two different rigged parameters.

Referring back to FIG. 19, the process adjusts parameters rigged to the master control based on adjustment to the master control. In some embodiments, process 1900 uses snapshots stored by process 1600 to adjust the values of the rigged parameters. When there is no match for a particular value of the master control in any saved snapshots, process 1900 uses an interpolation function to interpolate the value of the master control and the rigged parameters.

One of ordinary skill in the art will recognize that process 1900 is a conceptual representation of the operations used to setting relationships between master parameters and subordinate parameters. The specific operations of process 1900 may not be performed in the exact order shown and described. The specific operations may not be performed in one continuous series of operations, and different specific operations may be performed in different embodiments. Furthermore, the process could be implemented using several sub-processes, or as part of a larger macro process.

Figure 22:
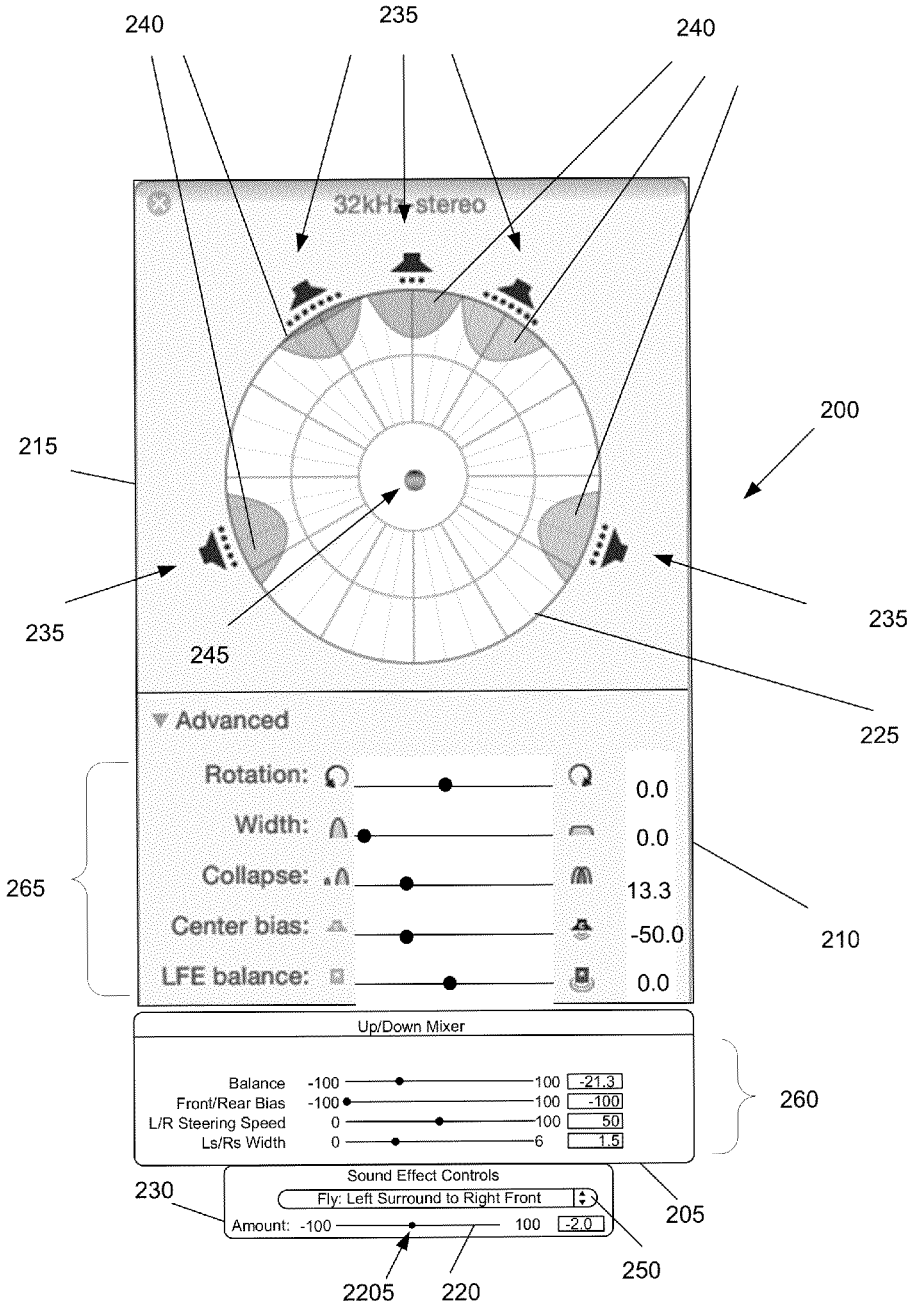
FIG. 22 shows the values of different parameters when the master control has moved after receiving a user selection input in some embodiments.
Figure 23:
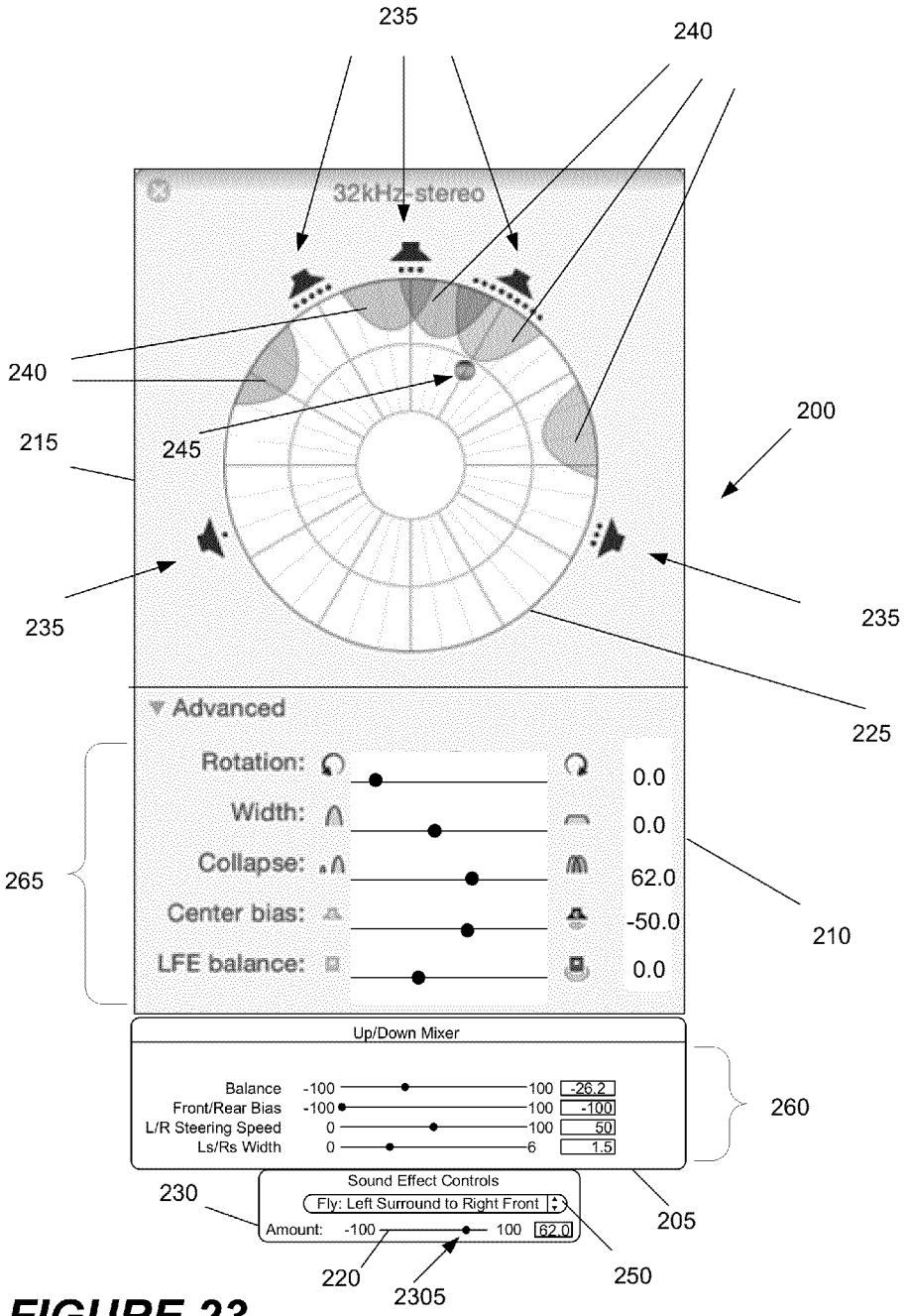
FIG. 23 shows the values of different parameters when the master control has moved after receiving a user selection input in some embodiments.

FIGS. 2, 22, and 23 illustrate an example of a master parameter that is rigged to several subordinate parameters to create a desired behavior (e.g., to create the effect that an object is flying from the left rear to the right front of the sound space). As shown in FIG. 2, the master control 220 has a value of −62.0. The puck 245 is at a position left and behind the center of the sound space 225. The values of other panning parameters 265, i.e., rotation, width, collapse, center bias, and LEF balance are 0.0, 0.0, 100.0, −50.0, and 0.0 respectively. The values of the decoding parameters 260, i.e., balance, front/rear bias, L/R steering speed, and Ls/Rs width are −30.0, −100, 50, and 1.5 respectively. Also as shown in FIG. 2, visual elements 240 are positioned around the left surround speaker which indicate the source channels are heard as coming from left and rear of a listener at the center of the sound space.

FIG. 22 shows the values of different parameters when the master control has moved from −62.0 to −2.0 after receiving a user selection input. The master control knob 2205 has moved after receiving a user selection input (e.g., through a touchscreen or a cursor control device) from the position corresponding to value −62.0 to the position corresponding to value −2.0. No other controls are moved through a user selection input. However, since the master control is rigged to several panning and decoding parameters, the value of these parameters and the position of their corresponding controls are changed. As shown, the puck 245 in FIG. 22 has automatically moved to almost the center of the sound space 225. The value of panning parameter collapse has automatically changed from 100 to 13.3. Furthermore, the value of decoding parameter balance has automatically changed from −30.0 to −21.3.

Accordingly, in order to create the fly left surround to right front effect, the master control 220 is rigged to the puck 245 (which controls panning x and y values), panning collapse parameter (which shows how much sound is relocated to a different location in the sound space), and the decoding balance parameter (which indicates how much of the original sound versus the decoded sound is sent to speakers 235). In this example, other panning and decoding parameters are not rigged to the master control in order to create the fly from left surround to right front effect. Also as shown in FIG. 22, visual elements 240 are moved in front of each speaker 235 which indicate the source channels are heard as coming out of their corresponding speakers by a listener at the center of the sound space.

FIG. 23 shows the values of different parameters when the master control has moved from −2.0 to 62.0 after receiving another user selection input. No other controls are moved through a user selection input. However, since the master controlled is rigged to the puck, panning collapse, and decoding balance parameters, the values of these parameters have automatically changed. As shown, the puck 245 in FIG. 23 has automatically moved to a position to the right and front of the center in the sound space. The value of panning parameter collapse has automatically changed from 13.3 to 62.0. Furthermore, the value of decoding parameter balance has automatically changed from −21.3 to −26.2. Also as shown in FIG. 23, visual elements 240 are moved towards the front right side of the sound space 225 which indicate the source channels are heard as coming from the right and front of a listener at the center of the sound space.

Figure 24:
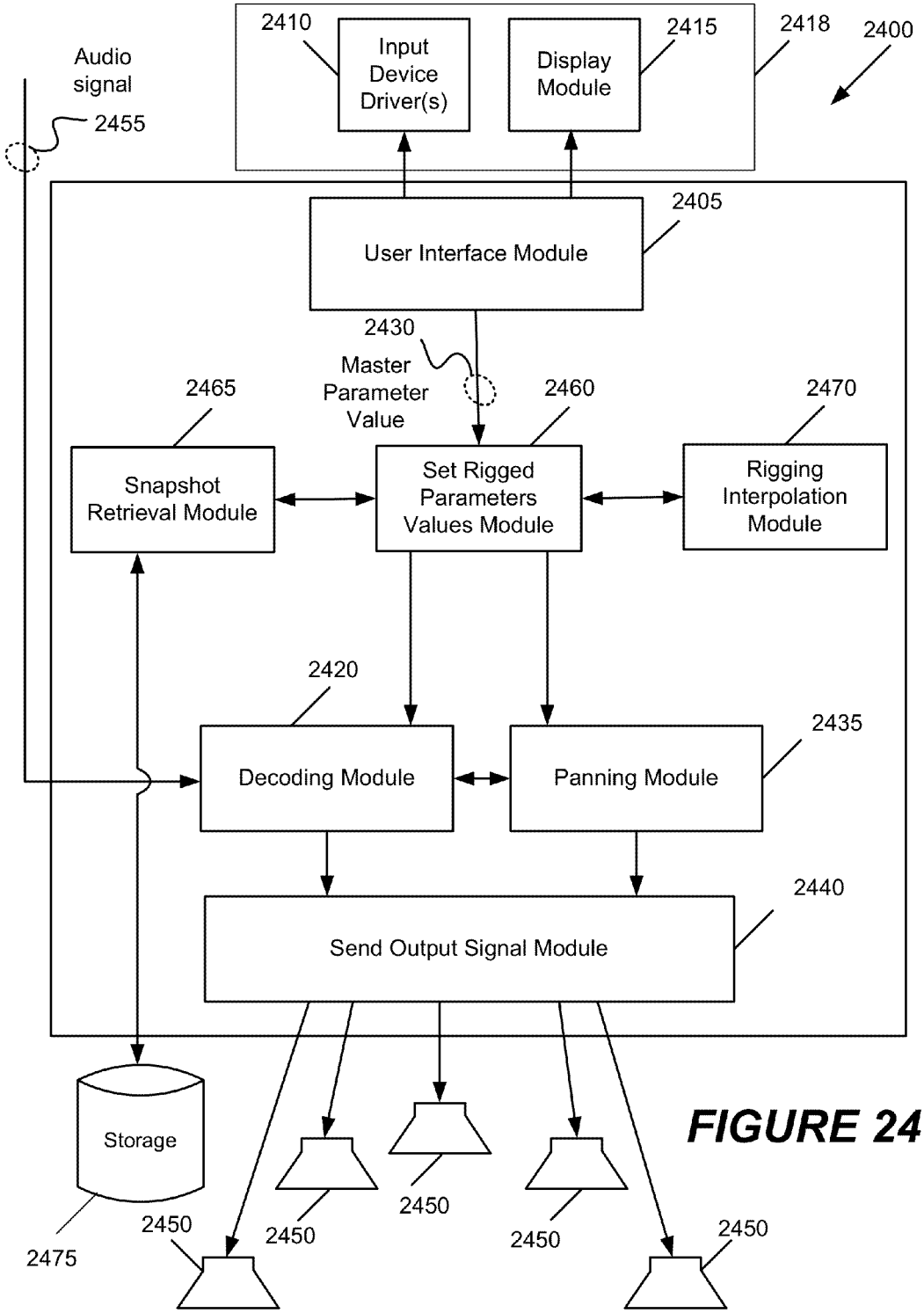
FIG. 24 illustrates a software architecture diagram of some embodiments for using rigged parameters to create an effect.

FIG. 24 conceptually illustrates a software architecture diagram of some embodiments for using rigged parameters to create an effect. As shown, the application includes a user interface module 2405, a set rigged parameters values module 2460, a snapshot retrieval module 2465, a rigging interpolation module 2470, a decoding module 2420, a panning module 2435, and a module 2440 to send the signals to the output speakers 1350. The user interface module 2405 interacts with a user through the input device driver(s) 2410 and the display module 2415.

The user interface module 2405 receives (e.g., through the GUI 200) the position of a master control (e.g., position of slider control 220) that controls the value of a master parameter that is rigged to a set of subordinate parameters. The user interface module passes the master parameter value 2430 to set rigged parameters values module 2460. The set rigged parameters values module 2460 uses the master parameter value 2430 to determine the values of the rigged parameters. When the value of the master parameter corresponding to the received master control position is stored in a snapshot, snapshot retrieval module 2465 retrieves the values of the rigged parameters from the storage 2475 and sends them to set rigged parameters values module 2460. When the value of the master parameter is not stored in a snapshot, the rigging interpolation module 2470 calculates the values of the rigged parameters by interpolating or extrapolating the values of the parameters rigged to the master parameter based on the received value of the master parameter, at least two saved adjacent positions of the master parameter, and the values of the rigged parameters corresponding to the saved adjacent master parameters. Set rigged parameters values module 2460 sends the values of the rigged parameters to decoding module 2420 and panning module 2435. The panning module 2435 and the decoding module 2420 use one or more of the techniques described in this specification to generate the output audio signal from a received input audio signal 2455. The "send output signal "module" sends the output audio signal to a set of speakers 2450 (five are shown).

FIG. 24 also illustrates an operating system 2418. As shown, in some embodiments, the device drivers 2410 and display module 2415 are part of the operating system 2418 even when the media editing application is an application separate from the operating system. The input device drivers 2410 may include drivers for translating signals from a keyboard, mouse, touchpad, drawing tablet, touchscreen, etc. A user interacts with one or more of these input devices, which send signals to their corresponding device driver. The device driver then translates the signals into user input data that is provided to the user interface module 2405.

IV. Graphical User Interface

Figure 25:
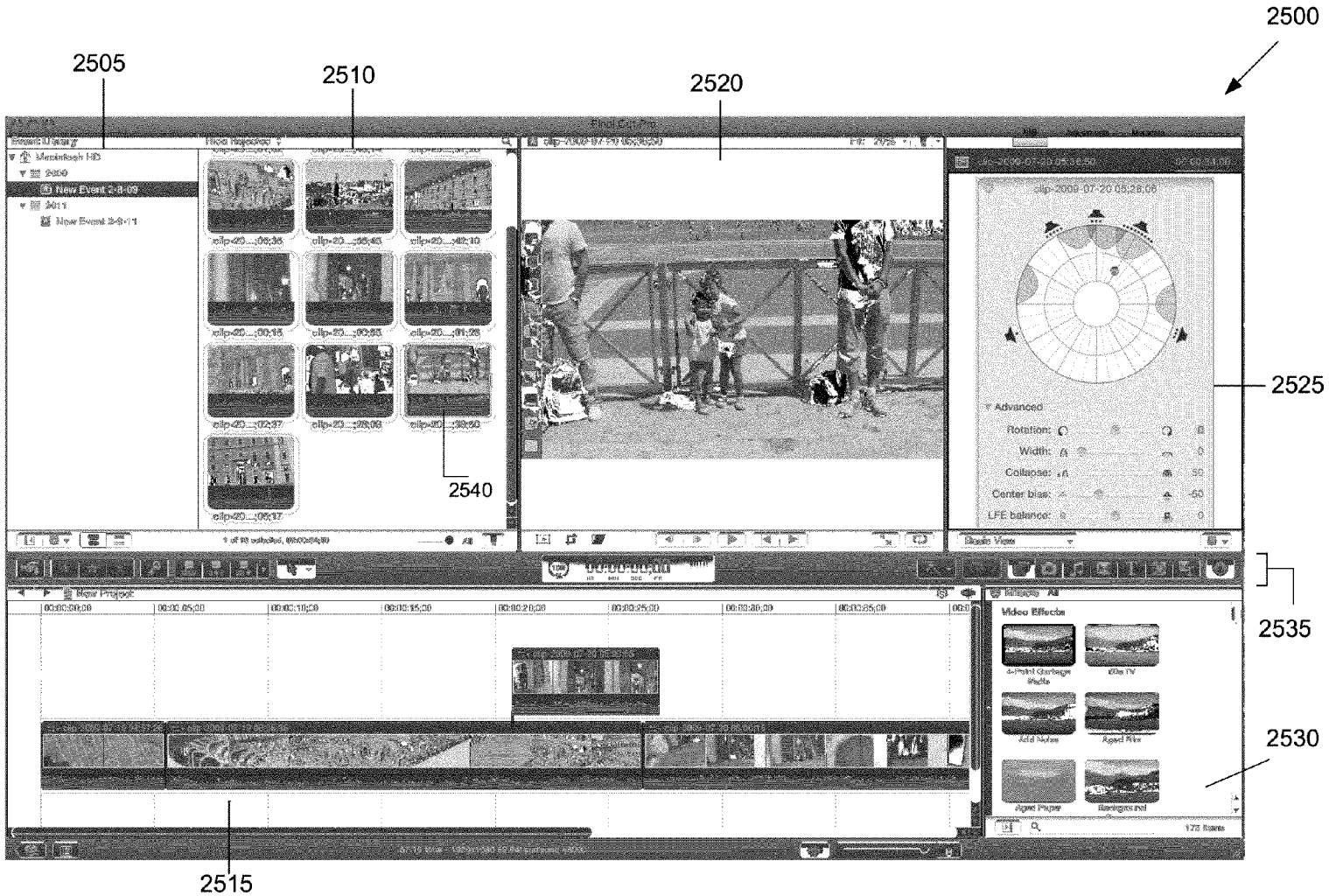
FIG. 25 conceptually illustrates the graphical user interface of a media-editing application in some embodiments.

FIG. 25 illustrates a graphical user interface (GUI) 2500 of a media-editing application of some embodiments. One of ordinary skill will recognize that the graphical user interface 2500 is only one of many possible GUIs for such a media-editing application. In fact, the GUI 2500 includes several display areas which may be adjusted in size, opened or closed, replaced with other display areas, etc. The GUI 2500 includes a clip library 2505, a clip browser 2510, a timeline 2515, a preview display area 2520, an inspector display area 2525, an additional media display area 2530, and a toolbar 2535.

The clip library 2505 includes a set of folders through which a user accesses media clips (i.e. video clips, audio clips, etc.) that have been imported into the media-editing application. Some embodiments organize the media clips according to the device (e.g., physical storage device such as an internal or external hard drive, virtual storage device such as a hard drive partition, etc.) on which the media represented by the clips are stored. Some embodiments also enable the user to organize the media clips based on the date the media represented by the clips was created (e.g., recorded by a camera).

Within a storage device and/or date, users may group the media clips into "events", or organized folders of media clips. For instance, a user might give the events descriptive names that indicate what media is stored in the event (e.g., the "New Event 2-8-09" event shown in clip library 2505 might be renamed "European Vacation" as a descriptor of the content). In some embodiments, the media files corresponding to these clips are stored in a file storage structure that mirrors the folders shown in the clip library.

Within the clip library, some embodiments enable a user to perform various clip management actions. These clip management actions may include moving clips between events, creating new events, merging two events together, duplicating events (which, in some embodiments, creates a duplicate copy of the media to which the clips in the event correspond), deleting events, etc. In addition, some embodiments allow a user to create sub-folders of an event. These sub-folders may include media clips filtered based on tags (e.g., keyword tags). For instance, in the "New Event 2-8-09" event, all media clips showing children might be tagged by the user with a "kids" keyword, and then these particular media clips could be displayed in a sub-folder of the event that filters clips in this event to only display media clips tagged with the "kids" keyword.

The clip browser 2510 allows the user to view clips from a selected folder (e.g., an event, a sub-folder, etc.) of the clip library 2505. As shown in this example, the folder "New Event 2-8-09" is selected in the clip library 2505, and the clips belonging to that folder are displayed in the clip browser 2510. Some embodiments display the clips as thumbnail filmstrips, as shown in this example. By moving a cursor (or a finger on a touchscreen) over one of the thumbnails (e.g., with a mouse, a touchpad, a touchscreen, etc.), the user can skim through the clip. That is, when the user places the cursor at a particular horizontal location within the thumbnail filmstrip, the media-editing application associates that horizontal location with a time in the associated media file, and displays the image from the media file for that time. In addition, the user can command the application to play back the media file in the thumbnail filmstrip.

In addition, the thumbnails for the clips in the browser display an audio waveform underneath the clip that represents the audio of the media file. In some embodiments, as a user skims through or plays back the thumbnail filmstrip, the audio plays as well.

Many of the features of the clip browser are user-modifiable. For instance, in some embodiments, the user can modify one or more of the thumbnail size, the percentage of the thumbnail occupied by the audio waveform, whether audio plays back when the user skims through the media files, etc. In addition, some embodiments enable the user to view the clips in the clip browser in a list view. In this view, the clips are presented as a list (e.g., with clip name, duration, etc.). Some embodiments also display a selected clip from the list in a filmstrip view at the top of the browser so that the user can skim through or playback the selected clip.

The timeline 2515 provides a visual representation of a composite presentation (or project) being created by the user of the media-editing application. Specifically, it displays one or more geometric shapes that represent one or more media clips that are part of the composite presentation. The timeline 2515 of some embodiments includes a primary lane (also called a "spine", "primary compositing lane", or "central compositing lane") as well as one or more secondary lanes (also called "anchor lanes"). The spine represents a primary sequence of media which, in some embodiments, does not have any gaps. The clips in the anchor lanes are anchored to a particular position along the spine (or along a different anchor lane). Anchor lanes may be used for compositing (e.g., removing portions of one video and showing a different video in those portions), B-roll cuts (i.e., cutting away from the primary video to a different video whose clip is in the anchor lane), audio clips, or other composite presentation techniques.

The user can add media clips from the clip browser 2510 into the timeline 2515 in order to add the clip to a presentation represented in the timeline. Within the timeline, the user can perform further edits to the media clips (e.g., move the clips around, split the clips, trim the clips, apply effects to the clips, etc.). The length (i.e., horizontal expanse) of a clip in the timeline is a function of the length of media represented by the clip. As the timeline is broken into increments of time, a media clip occupies a particular length of time in the timeline. As shown, in some embodiments the clips within the timeline are shown as a series of images. The number of images displayed for a clip varies depending on the length of the clip in the timeline, as well as the size of the clips (as the aspect ratio of each image will stay constant).

As with the clips in the clip browser, the user can skim through the timeline or play back the timeline (either a portion of the timeline or the entire timeline). In some embodiments, the playback (or skimming) is not shown in the timeline clips, but rather in the preview display area 2520.

In some embodiments, the preview display area 2520 (also referred to as a "viewer") displays images from video clips that the user is skimming through, playing back, or editing. These images may be from a composite presentation in the timeline 2515 or from a media clip in the clip browser 2510. In this example, the user has been skimming through the beginning of video clip 2540, and therefore an image from the start of this media file is displayed in the preview display area 2520. As shown, some embodiments will display the images as large as possible within the display area while maintaining the aspect ratio of the image.

The inspector display area 2525 displays detailed properties about a selected item and allows a user to modify some or all of these properties. In some embodiments, the inspector displays one of the GUIs shown in FIGS. 2, 17, 22, and 23. In some embodiments, the clip that is shown in the preview display area 2520 is selected, and thus the inspector display area 2525 displays the composite audio output information about media clip 2540. This information includes the audio channels and audio levels to which the audio data is output. In some embodiments, different composite audio output information is displayed depending on the particular setting of the panning and decoding parameters. As discussed above in detail by reference to FIGS. 2, 17, 22, and 23, the composite audio output information displayed in the inspector also includes user adjustable settings. For example, in some embodiments the user may adjust the puck to perform a panning operation. The user may also adjust certain settings (e.g. Rotation, Width, Collapse, Center bias, LFE balance, etc.) by manipulating the slider controls along the slider tracks, or by manually entering parameter values. The user may also change the setting of a control for a master parameter in order to change the rigged subordinate parameters to create an audio effect.

The additional media display area 2530 displays various types of additional media, such as video effects, transitions, still images, titles, audio effects, standard audio clips, etc. In some embodiments, the set of effects is represented by a set of selectable UI items, each selectable UI item representing a particular effect. In some embodiments, each selectable UI item also includes a thumbnail image with the particular effect applied. The display area 2530 is currently displaying a set of effects for the user to apply to a clip. In this example, several video effects are shown in the display area 2530.

The toolbar 2535 includes various selectable items for editing, modifying what is displayed in one or more display areas, etc. The right side of the toolbar includes various selectable items for modifying what type of media is displayed in the additional media display area 2530. The illustrated toolbar 2535 includes items for video effects, visual transitions between media clips, photos, titles, generators and backgrounds, etc. In addition, the toolbar 2535 includes an inspector selectable item that causes the display of the inspector display area 2525 as well as the display of items for applying a retiming operation to a portion of the timeline, adjusting color, and other functions.

The left side of the toolbar 2535 includes selectable items for media management and editing. Selectable items are provided for adding clips from the clip browser 2510 to the timeline 2515. In some embodiments, different selectable items may be used to add a clip to the end of the spine, add a clip at a selected point in the spine (e.g., at the location of a playhead), add an anchored clip at the selected point, perform various trim operations on the media clips in the timeline, etc. The media management tools of some embodiments allow a user to mark selected clips as favorites, among other options.

One or ordinary skill will also recognize that the set of display areas shown in the GUI 2500 is one of many possible configurations for the GUI of some embodiments. For instance, in some embodiments, the presence or absence of many of the display areas can be toggled through the GUI (e.g., the inspector display area 2525, additional media display area 2530, and clip library 2505). In addition, some embodiments allow the user to modify the size of the various display areas within the UI. For instance, when the display area 2530 is removed, the timeline 2515 can increase in size to include that area. Similarly, the preview display area 2520 increases in size when the inspector display area 2525 is removed.

V. Electronic System

Many of the above-described features and applications are implemented as software processes that are specified as a set of instructions recorded on a computer readable storage medium (also referred to as computer readable medium). When these instructions are executed by one or more computational or processing unit(s) (e.g., one or more processors, cores of processors, or other processing units), they cause the processing unit(s) to perform the actions indicated in the instructions. Examples of computer readable media include, but are not limited to, CD-ROMs, flash drives, random access memory (RAM) chips, hard drives, erasable programmable read only memories (EPROMs), electrically erasable programmable read-only memories (EEPROMs), etc. The computer readable media does not include carrier waves and electronic signals passing wirelessly or over wired connections.

In this specification, the term "software" is meant to include firmware residing in read-only memory or applications stored in magnetic storage which can be read into memory for processing by a processor. Also, in some embodiments, multiple software inventions can be implemented as sub-parts of a larger program while remaining distinct software inventions. In some embodiments, multiple software inventions can also be implemented as separate programs. Finally, any combination of separate programs that together implement a software invention described here is within the scope of the invention. In some embodiments, the software programs, when installed to operate on one or more electronic systems, define one or more specific machine implementations that execute and perform the operations of the software programs.

Figure 26:
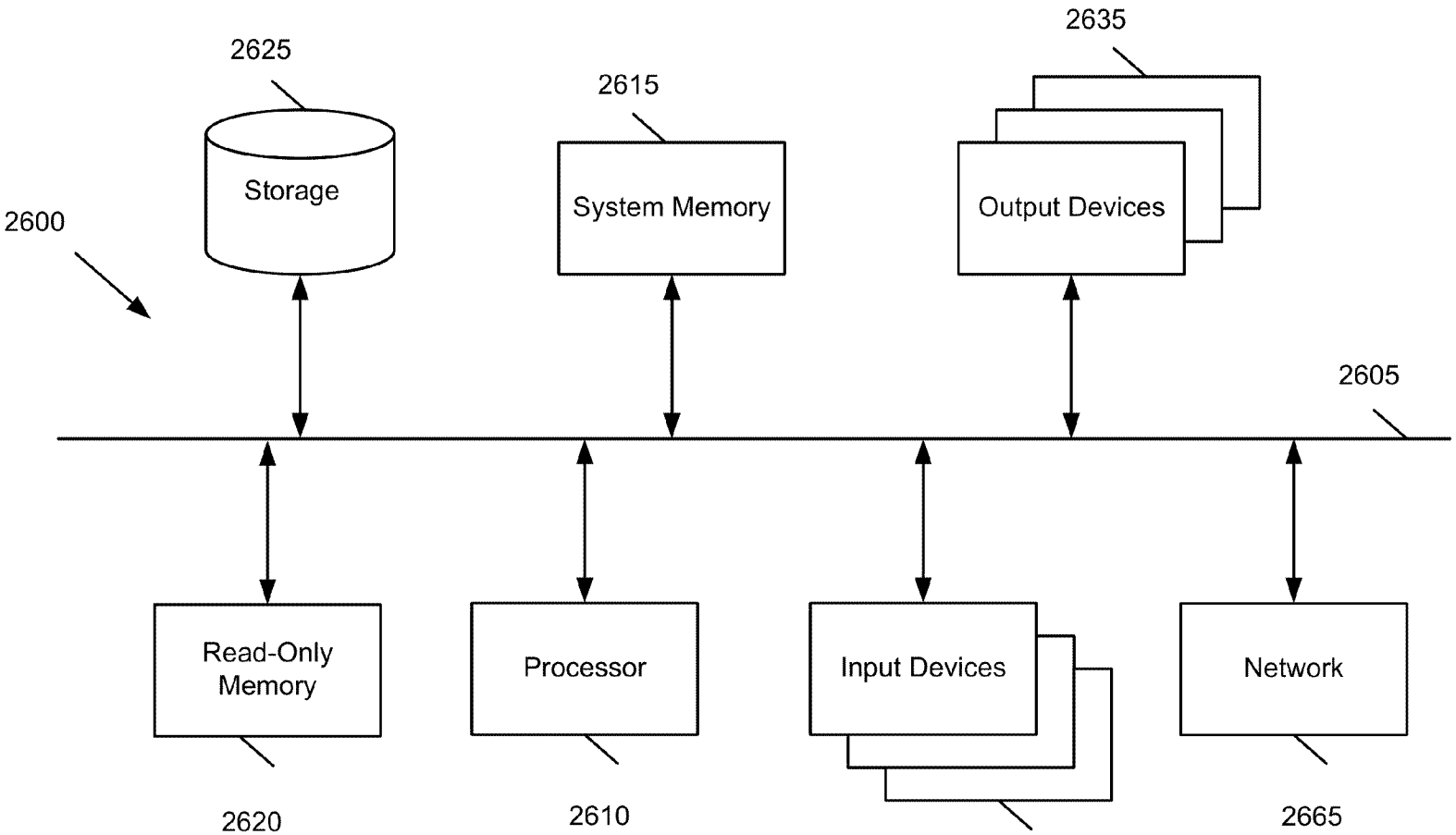
FIG. 26 conceptually illustrates an electronic system with which some embodiments are implemented.

FIG. 26 conceptually illustrates an electronic system 2600 with which some embodiments of the invention are implemented. The electronic system 2600 may be a computer (e.g., a desktop computer, personal computer, tablet computer, etc.), phone, PDA, or any other sort of electronic or computing device. Such an electronic system includes various types of computer readable media and interfaces for various other types of computer readable media. Electronic system 2600 includes a bus 2605, processing unit(s) 2610, a graphics processing unit (GPU) 2615, a system memory 2620, a network 2625, a read-only memory 2630, a permanent storage device 2635, input devices 2640, and output devices 2645.

The bus 2605 collectively represents all system, peripheral, and chipset buses that communicatively connect the numerous internal devices of the electronic system 2600. For instance, the bus 2605 communicatively connects the processing unit(s) 2610 with the read-only memory 2630, the GPU 2615, the system memory 2620, and the permanent storage device 2635.

From these various memory units, the processing unit(s) 2610 retrieves instructions to execute and data to process in order to execute the processes of the invention. The processing unit(s) may be a single processor or a multi-core processor in different embodiments. Some instructions are passed to and executed by the GPU 2615. The GPU 2615 can offload various computations or complement the image processing provided by the processing unit(s) 2610. In some embodiments, such functionality can be provided using CoreImage's kernel shading language.

The read-only-memory (ROM) 2630 stores static data and instructions that are needed by the processing unit(s) 2610 and other modules of the electronic system. The permanent storage device 2635, on the other hand, is a read-and-write memory device. This device is a non-volatile memory unit that stores instructions and data even when the electronic system 2600 is off. Some embodiments of the invention use a mass-storage device (such as a magnetic or optical disk and its corresponding disk drive) as the permanent storage device 2635.

Other embodiments use a removable storage device (such as a floppy disk, flash memory device, etc., and its corresponding disk drive) as the permanent storage device. Like the permanent storage device 2635, the system memory 2620 is a read-and-write memory device. However, unlike storage device 2635, the system memory 2620 is a volatile read-and-write memory, such a random access memory. The system memory 2620 stores some of the instructions and data that the processor needs at runtime. In some embodiments, the invention's processes are stored in the system memory 2620, the permanent storage device 2635, and/or the read-only memory 2630. For example, the various memory units include instructions for processing multimedia clips in accordance with some embodiments. From these various memory units, the processing unit(s) 2610 retrieves instructions to execute and data to process in order to execute the processes of some embodiments.

The bus 2605 also connects to the input and output devices 2640 and 2645. The input devices 2640 enable the user to communicate information and select commands to the electronic system. The input devices 2640 include alphanumeric keyboards and pointing devices (also called "cursor control devices"), cameras (e.g., webcams), microphones or similar devices for receiving voice commands, etc. The output devices 2645 display images generated by the electronic system or otherwise output data. The output devices 2645 include printers and display devices, such as cathode ray tubes (CRT) or liquid crystal displays (LCD), as well as speakers or similar audio output devices. Some embodiments include devices such as a touchscreen that function as both input and output devices.

Finally, as shown in FIG. 26, bus 2605 also couples electronic system 2600 to a network 2625 through a network adapter (not shown). In this manner, the computer can be a part of a network of computers (such as a local area network ("LAN"), a wide area network ("WAN"), or an Intranet, or a network of networks, such as the Internet. Any or all components of electronic system 2600 may be used in conjunction with the invention.

Some embodiments include electronic components, such as microprocessors, storage and memory that store computer program instructions in a machine-readable or computer-readable medium (alternatively referred to as computer-readable storage media, machine-readable media, or machine-readable storage media). Some examples of such computer-readable media include RAM, ROM, read-only compact discs (CD-ROM), recordable compact discs (CD-R), rewritable compact discs (CD-RW), read-only digital versatile discs (e.g., DVD-ROM, dual-layer DVD-ROM), a variety of recordable/rewritable DVDs (e.g., DVD-RAM, DVD-RW, DVD+RW, etc.), flash memory (e.g., SD cards, mini-SD cards, micro-SD cards, etc.), magnetic and/or solid state hard drives, read-only and recordable Blu-Ray® discs, ultra density optical discs, any other optical or magnetic media, and floppy disks. The computer-readable media may store a computer program that is executable by at least one processing unit and includes sets of instructions for performing various operations. Examples of computer programs or computer code include machine code, such as is produced by a compiler, and files including higher-level code that are executed by a computer, an electronic component, or a microprocessor using an interpreter.

While the above discussion primarily refers to microprocessor or multi-core processors that execute software, some embodiments are performed by one or more integrated circuits, such as application specific integrated circuits (ASICs) or field programmable gate arrays (FPGAs). In some embodiments, such integrated circuits execute instructions that are stored on the circuit itself In addition, some embodiments execute software stored in programmable logic devices (PLDs), ROM, or RAM devices.

As used in this specification and any claims of this application, the terms "computer", "server", "processor", and "memory" all refer to electronic or other technological devices. These terms exclude people or groups of people. For the purposes of the specification, the terms display or displaying means displaying on an electronic device. As used in this specification and any claims of this application, the terms "computer readable medium," "computer readable media," and "machine readable medium" are entirely restricted to tangible, physical objects that store information in a form that is readable by a computer. These terms exclude any wireless signals, wired download signals, and any other ephemeral signals.

While the invention has been described with reference to numerous specific details, one of ordinary skill in the art will recognize that the invention can be embodied in other specific forms without departing from the spirit of the invention. In addition, a number of the figures (including FIGS. 3, 15-16, and 19) conceptually illustrate processes. The specific operations of these processes may not be performed in the exact order shown and described. The specific operations may not be performed in one continuous series of operations, and different specific operations may be performed in different embodiments. Furthermore, the process could be implemented using several sub-processes, or as part of a larger macro process. Thus, one of ordinary skill in the art would understand that the invention is not to be limited by the foregoing illustrative details, but rather is to be defined by the appended claims.

While the invention has been described with reference to numerous specific details, one of ordinary skill in the art will recognize that the invention can be embodied in other specific forms without departing from the spirit of the invention. Thus, one of ordinary skill in the art would understand that the invention is not to be limited by the foregoing illustrative details, but rather is to be defined by the appended claims.

What is claimed is:

1. A method comprising:

receiving audio content in a set of input audio channels;

receiving a panning input to pan the audio content across a sound space comprising a plurality of output audio channels;

calculating a plurality of decoding parameters that are each a function of the panning input; and using the plurality of decoding parameters, surround sound decoding the input audio channels, said surround sound decoding specifying a panning for the input audio channels across the plurality of the output audio channels.

2. The method of claim 1, wherein the sound space comprises a set of speakers, wherein panning comprises creating an effect to a listener in the sound space that sound is moving from a first speaker to a different speaker.

3. The method of claim 1, wherein panning comprises spreading an audio signal in a source audio channel into a set of output audio channels.

4. The method of claim 1, wherein the sound space comprises a set of speakers, wherein panning comprises increasing a strength of sounds played at a first subset of speakers in the set of speakers and attenuating the strength of sounds played at a second different subset of speakers in the set of speakers.

5. The method of claim 1, wherein the set of input audio channels are encoded using a first set of mathematical formulas to transform a plurality of original sound channels into the set of input audio channels, wherein surround sound decoding comprises using a second set of mathematical formulas to transform the set of input audio channels into the plurality of the output channels to recover a reproduction of the original sound channels.

6. A method comprising:

receiving a first set of input audio channels, the set of input audio channels comprising audio content corresponding to a second set of recorded source audio channels;

receiving a panning input to pan the audio content across a sound space comprising a plurality of output audio channels;

calculating a plurality of decoding parameters that are each a function of the panning input;

using the plurality of decoding parameters, surround sound decoding the input audio channels to separate the recorded source audio channels; and distributing the separated recorded source audio channels across the plurality of the output audio channels to pan the audio content.

7. The method of claim 6, wherein panning the audio content comprises relocating audio content to a different location in the sound space, wherein the sound space comprises a plurality of speakers, wherein separating the recorded source audio channels prevents audio content from being folded into a same speaker.

8. The method of claim 6, wherein panning the audio content comprises relocating audio content to a different location in the sound space, wherein the sound space comprises a plurality of speakers, wherein separating the recorded source audio channels prevents audio content corresponding to a recorded source audio channel from being distributed to multiple speakers.

9. The method of claim 6, wherein the sound space comprises a plurality of speakers, each speaker corresponding to a recorded source audio channel, wherein panning the audio content comprises increasing a strength of sound in a first set of speakers and decreasing the strength of sound in a second set of speakers, wherein separating the recorded source audio channels prevents creating silence in a speaker when the corresponding recorded source audio channel comprises audio signals.

10. A non-transitory computer readable storage medium storing an application for editing media clips comprising multi-channel audio content, the application executable by at least one processing unit, the application comprising sets of instructions for:

receiving audio content in a set of input audio channels;

receiving a panning input regarding a manner for panning the audio content across a sound space comprising a plurality of output audio channels;

calculating a plurality of decoding parameters that are each a function of the panning input;

surround sound decoding the input audio channels using the plurality of decoding parameters; and panning, based on the received panning input, the surround sound decoded input audio channels across the plurality of the output audio channels.

11. The non-transitory computer readable storage medium of claim 10, wherein the sound space comprises a set of speakers, wherein panning comprises creating an effect to a listener in the sound space that sound is moving from a first speaker to a different speaker.

12. The non-transitory computer readable storage medium of claim 10, wherein panning comprises spreading an audio signal in a source audio channel into a set of output audio channels.

13. The non-transitory computer readable storage medium of claim 10, wherein the sound space comprises a set of speakers, wherein panning comprises increasing a strength of sounds played at a first subset of speakers in the set of speakers and attenuating the strength of sounds played at a second different subset of speakers in the set of speakers.

14. A method comprising:

receiving audio content in a plurality of input audio channels;

receiving a panning input to pan the audio content across a sound space comprising a plurality of output audio channels;

calculating a plurality of decoding parameters using a plurality of decoding functions, each decoding function defining a decoding parameter in the plurality of decoding parameters as a function of the panning input, the plurality of decoding functions comprising a function to calculate a decoding parameter controlling a decoder balance, a function to calculate a decoding parameter controlling a front and rear bias, and a function to calculate a decoding parameter controlling a left and right surround width; and surround sound decoding the plurality of input audio channels using the plurality of decoding parameters, the surround sound decoding specifying a panning for the input audio channels across the plurality of the output audio channels.

15. The method of claim 14, wherein the panning input comprises a set of coordinates in the sound space.

16. The method of claim 15, wherein the set of coordinates represent a point at which a collective sound of all of the input audio channels appear to originate from a perspective of a listener in the middle of the sound space.

17. A method comprising:

receiving audio content in a plurality of input audio channels;

receiving a first set of panning inputs to pan the audio content across a sound space comprising a plurality of speakers;

calculating a plurality of decoding parameters that are each a function of the panning input; and surround sound decoding the input audio channels using the plurality of decoding parameters, wherein when the set of panning inputs has a first set of values, surround sound decoding distributes a combination of surround sound decoded audio content and undecoded audio content to a first set of speakers in the plurality of speakers, and wherein when the set of panning inputs has a second set of values, surround sound decoding only distributes the undecoded audio content to a second set of speakers in the plurality of speakers.

18. The method of claim 17, wherein the set of panning inputs identify a position in the sound space, wherein the first set of values identify an extreme left position or an extreme right position in the sound space.

19. The method of claim 17, wherein the set of panning inputs identify a position in the sound space, wherein the second set of values identify an extreme front position or an extreme rear position in the sound space.

* * * * *